US010025209B2

(12) United States Patent
Shingu et al.

(10) Patent No.: US 10,025,209 B2
(45) **Date of Patent: *Jul. 17, 2018**

(54) METALLIC INGOT FOR IMPACT PRESSING, CYLINDRICAL METAL MEMBER, AND ELECTROPHOTOGRAPHIC PHOTORECEPTOR

(71) Applicant: FUJI XEROX CO., LTD., Tokyo (JP)

(72) Inventors: Kenta Shingu, Kanagawa (JP); Hiroshi Tamemasa, Kanagawa (JP); Daisuke Haruyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/485,815

(22) Filed: Apr. 12, 2017

(65) Prior Publication Data

US 2018/0173123 A1 Jun. 21, 2018

(30) Foreign Application Priority Data

Dec. 20, 2016 (JP) ..... 2016-246897

(51) Int. Cl.

| | |
|---|---|
| ***G03G 5/00*** | (2006.01) |
| ***G03G 5/10*** | (2006.01) |
| ***B05D 1/18*** | (2006.01) |
| ***B05D 7/14*** | (2006.01) |
| ***B05D 5/06*** | (2006.01) |
| ***B05D 3/02*** | (2006.01) |
| ***G03G 5/06*** | (2006.01) |
| ***G03G 5/05*** | (2006.01) |
| ***G03G 5/047*** | (2006.01) |
| ***G03G 5/14*** | (2006.01) |
| ***B21C 1/22*** | (2006.01) |
| ***B21C 23/08*** | (2006.01) |
| ***B05D 3/00*** | (2006.01) |

(52) U.S. Cl.

CPC ..... *G03G 5/102* (2013.01); *B05D 1/18* (2013.01); *B05D 3/002* (2013.01); *B05D 3/0254* (2013.01); *B05D 5/06* (2013.01); *B05D 7/148* (2013.01); *B21C 1/22* (2013.01); *B21C 23/085* (2013.01); *G03G 5/047* (2013.01); *G03G 5/0517* (2013.01); *G03G 5/0525* (2013.01); *G03G 5/0542* (2013.01); *G03G 5/0564* (2013.01); *G03G 5/0614* (2013.01); *G03G 5/0696* (2013.01); *G03G 5/144* (2013.01)

(58) Field of Classification Search

CPC ..... G03G 5/102; B05D 3/002; B21C 1/22; B21C 23/085

USPC ..... 430/69

See application file for complete search history.

(56) References Cited

U.S. PATENT DOCUMENTS

2017/0269485 A1* 9/2017 Shingu ..... G03G 15/75

FOREIGN PATENT DOCUMENTS

JP 2008-132503 A 6/2008

* cited by examiner

*Primary Examiner* — Mark A Chapman

(74) *Attorney, Agent, or Firm* — Sughrue Mion, PLLC

(57) ABSTRACT

A metallic ingot for impact pressing includes a contact surface of the metallic ingot to contact a male mold in impact pressing having a maximum height roughness Rz of 20 μm to 50 μm and an average length of a roughness curve element RSm of 150 μm to 400 μm, the male mold being to be used in combination with a female mold in the impact pressing.

7 Claims, 14 Drawing Sheets

METALLIC INGOT FOR IMPACT PRESSING, CYLINDRICAL METAL MEMBER, AND ELECTROPHOTOGRAPHIC PHOTORECEPTOR

CROSS-REFERENCE TO RELATED APPLICATIONS

This application is based on and claims priority under 35 USC 119 from Japanese Patent Application No. 2016-246897 filed Dec. 20, 2016.

BACKGROUND

1. Technical Field

The present invention relates to a metallic ingot for impact pressing, cylindrical metal member, and an electrophotographic photoreceptor.

2. Related Art

In the related art, as an electrophotographic image forming apparatus, an apparatus sequentially performing steps of charging, exposing, developing, transferring, cleaning, and the like by using an electrophotographic photoreceptor (hereinafter, referred to as a "photoreceptor" in some cases) has been widely known.

Examples of the electrophotographic photoreceptor include a function-separated type photoreceptor which is obtained by stacking a charge generation layer for generating charges by exposure and a charge transport layer for transporting the charges on a support such as aluminum having conductivity, and a single layer-type photoreceptor that has functions of generating and transporting the charges in the same layer.

As a method of preparing a cylindrical substrate which corresponds to the electroconductive substrate of the electrophotographic photoreceptor, a method of adjusting a thickness, surface roughness, and the like by cutting an outer circumferential surface of a tube material of aluminum or the like has been known.

Meanwhile, as a method of mass-producing a thin metal container or the like with low cost, an impact pressing method of forming a cylindrical metal member by imparting a shock (impact) to a metallic ingot (slag) which is disposed in a female mold (a concave die) by a male mold (a punch) has been known.

SUMMARY

According to an aspect of the invention, there is provided a metallic ingot for impact pressing, wherein a contact surface of the metallic ingot to contact a male mold in impact pressing has a maximum height roughness Rz of from 20 μm to 50 μm and an average length of a roughness curve element RSm of from 150 μm to 400 μm, the male mold being to be used in combination with a female mold in the impact pressing.

BRIEF DESCRIPTION OF THE DRAWINGS

Exemplary embodiments of the present invention will be described in detail based on the following figures, wherein.

DETAILED DESCRIPTION

Figure 1:
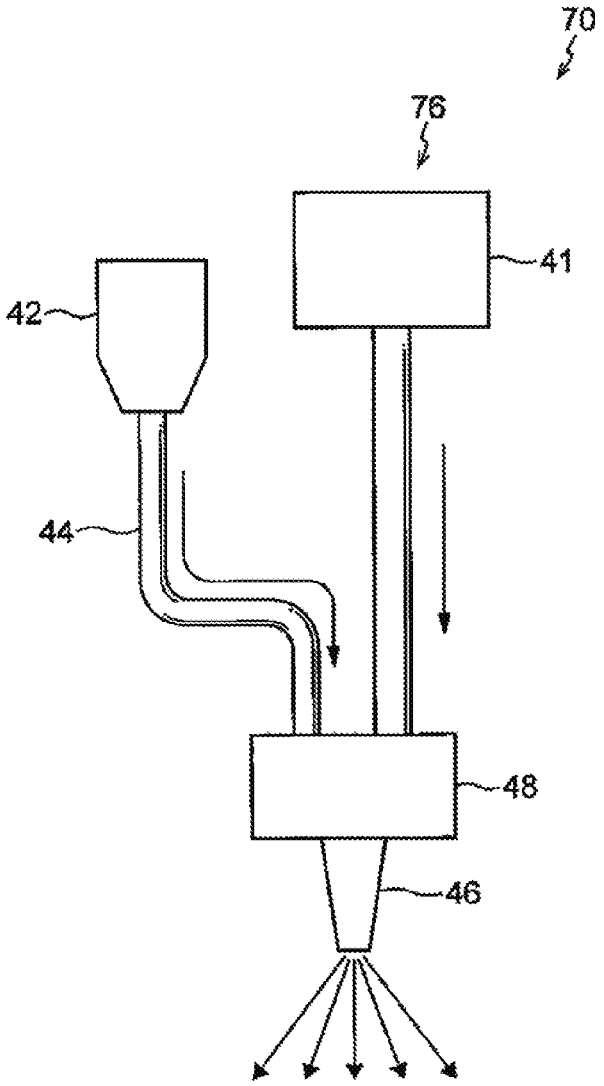
FIG. 1 is a schematic diagram illustrating a blasting apparatus in the exemplary embodiment.

Hereinbelow, exemplary embodiments will be described as an example of the present invention.

Metallic Ingot for Impact Pressing

A metallic ingot for impact pressing (hereinafter, also referred to as a "metallic ingot") according to the exemplary embodiment is a metallic ingot which is used in impact pressing in which the metallic ingot is pressurized as being disposed in a female mold by suing a male mold and then plastically deformed on outer circumferential surface of the male mold so as to form a cylindrical member.

In addition, a slag according to the exemplary embodiment has a roughness Rz in the maximum height of a contact surface of the male mold with which the male mold, among the male mold and the female mold which are used in the impact pressing, is in contact is from 20 μm to 50 μm, and an average length RSm, of a roughness curve element of the contact surface of the male mold is from 150 μm to 400 μm.

Note that, in the following description, the metallic ingot, the male mold, the female mold (die) , the contact surface of the male mold of the metallic ingot, and the thickness of the cylindrical metal member are also respectively referred to as the "slag", a "punch", a "concave die", as a "punch contact surface", and a "thickness".

In addition, a punch contact surface (the contact surface of the male mold) of the metallic ingot means a surface with which the punch (the male mold) is firstly in contact when the impact pressing is started.

Here, in the impact pressing, as described above, the slag is pressurized by the punch and then plastically deformed on the outer circumferential surface of the punch so as to form the cylindrical metal member. In this case, a portion on the punch contact surface side of the slag is extended while being in contact with the outer circumferential surface of the punch such that the slag is plastically deformed.

However, in the impact pressing, it is difficult to control the uniformity of the thickness as compared with a cutting step and thus is difficult to be applied to applications requiring high shape accuracy. Specifically, in applications requiring the uniformity of the thickness, that is, in an electroconductive substrate of a photoreceptor, thickness variation may occur.

The reason for the occurrence of the thickness variation is considered to be exhaustion of a lubricant which is imparted to the punch contact surface of the slag. In other words, it is considered that when the slag is extended in the punch outer circumferential surface, the exhaustion of the lubricant partially occurs in the circumferential direction of the punch outer circumferential surface. Further, it is considered that the exhaustion of the lubricant is more likely to occur when the slag is extended on the punch outer circumferential surface on the side opposite to the slag contact surface than when the slag is extended in the punch outer circumferential surface on the slag contact surface side.

For this reason, it is considered that extension states of the slags in the circumferential direction of the punch outer circumferential surface are different from each other, and extension states of the slags on the punch outer circumferential surface on the slag contact surface side and on the punch outer circumferential surface on the side opposite to the slag contact surface are different from each other, and thus the thickness variation occurs.

In this regards, in the slag according to the exemplary embodiment, the roughness Rz in the maximum height and the average length RSm of the roughness curve element of the punch contact surface are set within the above-described range. That is, as compared with the related art, the roughness Rz in the maximum height is set to be large, and the average length RSm of the roughness curve element is set to be short such that deep concave portions are present at short intervals on the punch contact surface. With this, a holding amount and a holding force of the lubricant are increased on the punch contact surface, and thus the exhaustion of the lubricant is prevented. For this reason, the extension states of the slags in the circumferential direction of the punch outer circumferential surface become similar to each other. In addition, the extension state of the slaps on the punch outer circumferential surface on the slag contact surface side and the punch outer circumferential surface on the side opposite to the slag contact surface become similar to each other.

From the above description, it is presumed that as the slag according to the exemplary embodiment, a cylindrical metal member in which the thickness variation is prevented can be obtained through the impact pressing.

Hereinafter, the slag according to the exemplary embodiment will be described in detail.

A material, a shape, a size, and the like of the slag may be selected in accordance with the application of the cylindrical metal member to be manufactured. For example, in a case of preparing an electroconductive substrate for forming a photoreceptor through the impact pressing, a disk-shaped slag formed of aluminum or an aluminum alloy, or a columnar slag is preferably used.

Note that, depending on the application of the cylindrical metal member to be manufactured, slags such as an elliptic columnar slag and a prismatic slag may be used.

Examples of the aluminum alloy contained in the slag include an aluminum alloy containing Si, Fe, Cu, Mn, Mg, Cr, Zn, and Ti in addition to aluminum.

The aluminum alloy contained in the slag which is used to manufacture the cylindrical metal member of the electrophotographic photoreceptor is preferably a so-called 1000-series alloy.

The aluminum content of (aluminum purity: weight ratio) of the slag is preferably equal to or greater than 90.0%, is further preferably equal to or greater than 93.0%, and is still further preferably equal to or greater than 95.0%, from the point of view of workability.

The roughness Rz in the maximum height of the punch contact surface of the slag is from 20 μm to 50 μm, is preferably from 25 μm to 45 μm, and is further preferably from 30 μm to 40 μm from the viewpoint that the thickness variation of the obtained cylindrical metal member is prevented.

The roughness Rz in the maximum height is a total sum of the maximum height of a peak and the maximum depth of a trough of the roughness curve in the reference length which is regulated by JIS B0601 (2013) , and a value measured by using a surface roughness measuring machine (SURFCOM, manufactured by Tokyo Seimitsu Co., Ltd.). The measuring method will be described in detail.

The average length RSm of the roughness curve element of the punch contact surface of the slag is from 150 μm to 400 μm, is preferably from 200 μm to 350 μm, and is further preferably from 220 μm to 300 μm from the viewpoint that the thickness variation of the obtained cylindrical metal member is prevented.

The average length RSm of the roughness curve element is an average length of the roughness curve element in the reference length which is regulated by JIS B0601 (2013) , and is a value measured by using a surface roughness measuring machine (SURFCOM, manufactured by Tokyo Seimitsu Co., Ltd.). The measuring method will be described in detail.

Here, the measurement of the roughness Rz in the maximum height and the average length RSm of the roughness curve element is performed as follows.

The surface shape (roughness curve) is measured by scanning a region having a length of 20 mm between a position at 10 mm and a position at 30 mm from the slag circumference side toward the center direction of the punch contact surface of the slag. Measurement conditions are set based on JIS B0601 (2013) as follows; Evaluation length Ln=4.0 mm, Reference length L=0.8 mm, and Cutoff value=0.8 mm.

In addition, the aforementioned operation is performed at three portions, and the obtained average values are set to be the roughness Rz in the maximum height and the average length RSm of the roughness curve element.

Method of Preparing Metallic Ingot for Impact Pressing

A method of preparing a metallic ingot (slag) for impact pressing according to the exemplary embodiment is not particularly limited as long as it is a method of controlling the roughness Rz in the maximum height of the punch contact surface of the slag and the average length RSm in the axial direction to be within the above range.

For example, the method of preparing the slag according to the exemplary embodiment includes a step of obtaining a metallic ingot by punching a metal plate with a mold for punching, or a step of obtaining a metallic ingot by cutting a metal column. In addition, at least one of the metal plate, the metal column, and the slag is subjected to a roughening treatment such that the roughness Rz in the maximum height and the average length RSm of the roughness curve element of the punch contact surface of the slag are within the above range.

In other words, at least one of the surface of the metal plate, which corresponds to the punch contact surface of the punched slag, and the surface of the metal column, which corresponds to the punch contact surface of the cut slag, and the punch contact surface of the slag is subjected to the roughening treatment.

Here, the metal plate is a plate-shaped metal material having the thickness corresponding to the height (thickness) of the slag. The slag is obtained by punching the metal plate from the surface side with the mold for punching.

Further, the metal column is a columnar (or rod-shaped) metal material of which a cross section intersecting with the longitudinal direction corresponds to the punch contact surface of the slag. The slag is obtained by cutting the metal column to the length corresponding to the height (thickness) of the slag.

Examples of the roughening treatment include various types of treatments (various types of treatments in which the ruggedness is imparted to the surface) such as an etching treatment, an anodizing treatment, a rough cutting treatment, a centerless grinding treatment, a blasting treatment (for example, a sandblasting treatment), and a wet honing treatment. Further, examples of the roughening treatment also include a treatment in which the surface shape of the mold for punching is transferred to the slag when the metal plate is punched (specifically, a treatment in which a surface shape of a mold which is in contact with the surface of the metal plate, which corresponds to the punch contact surface of the slag, is transferred and roughened by pressurizing at the time of the punching).

Among them, the blasting treatment and. the treatment in which the surface shape of the mold for punching is transferred to the slag when the metal plate is punched are preferable as the roughening treatment.

That is, the roughening treatment is preferably at least one selected from a blasting treatment on the metal plate, a blasting treatment on the metal column, a blasting treatment on the slag, and a treatment in which the surface shape of the mold for punching is transferred to the slag when the metal plate is punched.

The roughness Rz in the maximum height and the average length of the roughness curve element of the punch contact surface of the slag which is finally obtained by combining plural roughening treatments described above may be controlled to be within the above range.

Note that, "the surface shape of the mold for punching" for transferring the punch contact surface of the slag is preferably obtained through the blasting treatment among the above-described roughening treatments.

Hereinafter, the blasting treatment will be described.

First, a blasting apparatus for implementing the blasting treatment will be described. A sandblasting apparatus will be described as an. example of the blasting apparatus.

As illustrated in FIG. 1, the blasting apparatus 76 is provided with a compressing machine (compressor) 41 for supplying compressed air, a container (tank) 42 for storing a polishing material (not shown), a mixing unit 48 for mixing the polishing material supplied via a supply tube 44 from the tank 42 and the compressed air supplied from the compressor 41, and a nozzle 46 for ejecting the polishing material from the mixing unit 48 under the compressed air such that the ejected polishing material is blown to a target to be treated (not shown).

In addition, the blasting treatment using the blasting apparatus 76 is performed as follows.

First, as illustrated in FIG. 1, the polishing material (not shown) stored in the tank 42 is supplied to the mixing unit 48 via the supply tube 44, and the polishing material and the compressed air supplied from the compressor 41 are mixed with each other in the mixing unit 48. Then, the polishing material is elected from the mixing unit 48 via nozzle 46 under the compressed air such that the ejected polishing material is blown to a processing target (not shown). With this, a surface of a target to be treated (not shown) is roughened.

The polishing material is not particularly limited, and well-known polishing materials may be used. Examples of the well-known polishing materials include metal (for example, stainless steel, iron, and zinc), ceramic (for example, zirconia, alumina, silica, and silicon carbide), and a resin (for example, polyamide and polycarbonate).

From the viewpoint that the roughness Rz in the maximum height and the average length RSm of the roughness curve element of the punch contact surface of the slag is controlled to be within the above-described range through one blasting treatment, the size of the polishing material, the blasting pressure and the blasting time preferably fall within the following ranges. Note that, the blasting pressure of the polishing material means the pressure when the polishing material is blown to a target to be treated.

The size of the polishing material is, for example, preferably from 30 μm to 300 μm, and is further preferably from 60 μm to 250 μm.

The blasting pressure of the polishing material is, for example, preferably from 0.1 MPa to 0.5 MPa, and is further preferably from 0.15 MPa to 0.4 MPa.

The blasting time of the polishing material is, for example, preferably from 5 seconds to 30 seconds, and is further preferably from 10 seconds to 20 seconds.

Meanwhile, a supply source of the compressed air is not particularly limited, and may be a centrifugal blowing device (blower) instead of the compressor 41, and the compressed air is not necessarily used. In addition, an ejection medium may be a gas other than air.

Cylindrical Metal Member

The thickness unevenness of the cylindrical metal member according to the exemplary embodiment is equal to or less than 40 μm, the roughness Rz in the maximum height of the inner circumferential surface is from 0.5 μm to 20 μm, the average length RSm of the roughness curve element of the inner circumferential surface is from 50 μm to 300 μm, and the outer circumferential surface hardness is from 45 HV to 60 HV.

When the cylindrical metal member according to the exemplary embodiment has the above-described configuration, the thickness variation is prevented. In addition, the inner circumferential surface of the cylindrical metal member has the aforementioned surface properties, and thus the flange fitting strength becomes higher when a flange is fitted into the cylindrical metal member.

The thickness unevenness (thickness variation) of the cylindrical metal member is equal to or less than 40 μm, but is preferably equal to or less than 35 μm, and is further preferably equal to or less than 30 μm from the viewpoint that the thickness variation is prevented. The lower limit of the thickness variation is preferably 0, and is, for example, equal to or greater than 5 μm from the viewpoint of productivity.

The thickness variation is measured by using the following method. The thickness at 36 points is measured every 10 degrees in the circumferential direction from an arbitrary point from an opening at one end of the cylindrical metal member using an ultrasonic thickness meter. Then, the maximum value and the minimum value of the thickness are calculated. This operation is performed on the thickness at 18 points every 10 mm in the axial direction of the cylindrical metal member, and then the obtained average value is set as the thickness variation.

The roughness Rz in the maximum height of the inner circumferential surface of the cylindrical metal member is from 0.5 μm to 20 μm, is preferably from 5 μm to 20 μm, is further preferably from 8 μm to 17 μm, and is still further preferably from 10 μm to 15 μm.

The average length RSm of the roughness curve element of the inner circumferential surface of the cylindrical metal member is from 50 μm to 300 μm, is preferably from 100 μm to 250 μm, and is further preferably from 120 μm to 200 μm.

The roughness Rz in the maximum height and the average length RSm of the roughness curve element of the inner circumferential surface of the cylindrical metal member is regulated in based on JIS B0601 (2013) as described in the case of the slag. In addition, Rz and RSm are measured by the following method.

In the axial direction of the inner circumferential surface of the cylindrical metal member, the surface shape (roughness curve) is measured by scanning a total region having a length of 120 mm of a region having a length of 40 mm between a position at 10 mm and a position at 50 mm from one side, a region having a length of 40 mm between a position at 10 mm and a position at 50 mm from the other side, and a region having a length of 40 mm of a center portion of the cylindrical metal member. Note that, the scanning in the axial direction is performed every 10 degrees 36 times in total in the circumferential direction.

In addition, the Rz and RSm are calculated based on the roughness curve obtained through the above-described scanning.

Note that, the measurement conditions are set based on JIS B0601 (2013) as follows; Evaluation length Ln=4.0 mm, Reference length L=0.8 mm, and Cutoff value=0.8 mm.

The outer circumferential surface hardness of the cylindrical metal member is from 45 HV to 60 HV, is preferably from 48 HV to 58 HV, and is further preferably from 50 HV to 55 HV in order to enhance the mechanical strength.

The outer circumferential surface hardness (Vickers hardness) of the cylindrical metal member is measured by bushing an indenter from the surface of the cylindrical metal member with a Vickers hardness tester (product name: MVK-HVL, manufactured by Mitutoyo Corporation) based on the measurement conditions of pushing load of 1 kgf and pushing time of 20 seconds. The measurement is performed at total 12 points for each sample, for example, four points in the circumferential direction and three points in the axial direction. In the exemplary embodiment, the outer circumferential surface hardness of the cylindrical metal member is the average value of the hardness measured at the aforementioned 12 points.

The thickness of the cylindrical metal member is not particularly limited, and is determined depending on the applications thereof. For example, the thickness of the cylindrical metal member is preferably from 0.3 mm to 0.7 mm, and further preferably from 0.35 mm to 0.5 mm.

Here, the cylindrical metal member which satisfies the above-described properties is preferably an impact press tube manufactured by impact pressing.

The impact press tube generally has high hardness (for example, equal to or greater than 45 HV) through the work hardening. Accordingly, when the impact press tube is employed as the cylindrical metal member, the high hardness is realized as compared with the cylindrical metal member which is subjected to the cutting process on the surface of the same type of aluminum cylindrical tube (tube material). In addition, according to the impact press tube, it is possible to reduce the thickness of the cylindrical metal member.

The cylindrical metal member may be applied as an electroconductive substrate for an electrophotographic photoreceptor, for example. Besides, the cylindrical metal member may also be applied to a fuel cell container and the like.

The method of preparing a cylindrical metal member according to the exemplary embodiment is not particularly limited, and is preferably a preparing method in which the impact pressing is applied. Specific examples will be described below.

For example, the method of preparing a cylindrical metal member according to the exemplary embodiment includes an impact pressing step disposing a slag in which a lubricant is imparted at least onto the punch contact surface in a female mold (a concave die), pressurizing the slag disposed in the female mold by using a male mold (a punch), and plastically deforming the slag on the outer circumferential surface of the male mold so as to form a cylindrical metal member. In addition, the aforementioned method may include an ironing step of ironing the outer circumferential surface of the cylindrical metal member by causing the cylindrical metal member formed in the impact pressing step to pass through the inner portion of an annular pressing mold having an inner diameter which is smaller than the outer diameter of the cylindrical metal member.

In addition, as a slag, the slag according to the exemplary embodiment is applied. For this reason, according to the method of preparing a cylindrical metal member according to the exemplary embodiment, it is possible to obtain the cylindrical metal member in which the thickness variation is prevented. In addition, according to the above-described preparing method, it is possible to obtain the cylindrical metal member (impact press tube) having the high hardness as compared with the cylindrical metal member manufactured in the cutting step.

Hereinafter, an example of the method of preparing a cylindrical metal member of the exemplary embodiment will be described with reference to FIG. 2 to FIG. 11.

In the following description, members having substantially the same function are denoted the same signs all through the drawings, and repeated description and signs are omitted in some cases. Note that, an arrow "UP" in the drawings indicates upward in the vertical direction.

First, a manufacturing apparatus 70 of the cylindrical metal member will be described, and then a method of manufacturing a cylindrical metal member which is performed by using the manufacturing apparatus 70 of the cylindrical metal member will be described.

Major Components: Manufacturing Apparatus of Cylindrical Metal Member

The manufacturing apparatus 70 of the cylindrical metal member includes an impact pressing apparatus 72 that forms the cylindrical metal member 100, an ironing apparatus 74 that corrects the shape of cylindrical metal member 100, and a blasting apparatus 76 that causes the ruggedness on the outer circumferential surface of the cylindrical metal member 100.

Hereinafter, the impact pressing apparatus 72 and the ironing apparatus 74 are described in order.

Impact Pressing Apparatus

Figure 2A:
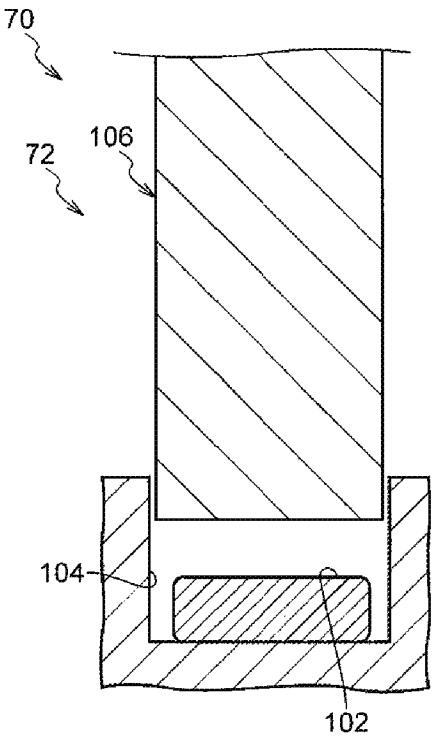
FIGS. 2A to 2C are schematic diagrams illustrating impact pressing apparatuses in the exemplary embodiment.

As illustrated in FIG. 2A, the impact pressing apparatus 72 is provided with a concave mold 104 in which a slag 102 which is an aluminum ingot is stored, and a columnar punch 106 which compresses the slag 102 stored in the concave die 104 such that the slag 102 is made to be a cylindrical member (the cylindrical metal member).

Meanwhile, operations of the respective portions of the impact pressing apparatus 72 are described in actions in the following description, and when the impact pressing apparatus 72 is used, one end portion 100A is opened and a cylindrical metal member 100 (refer to FIG. 4B) having a bottom plate 100B is formed at another end portion.

Ironing Apparatus

Next, the ironing apparatus 74 will be described. Note that, regarding the ironing apparatus 74, a mold structure provided in the ironing apparatus 74 will be mainly described.

Figure 3:
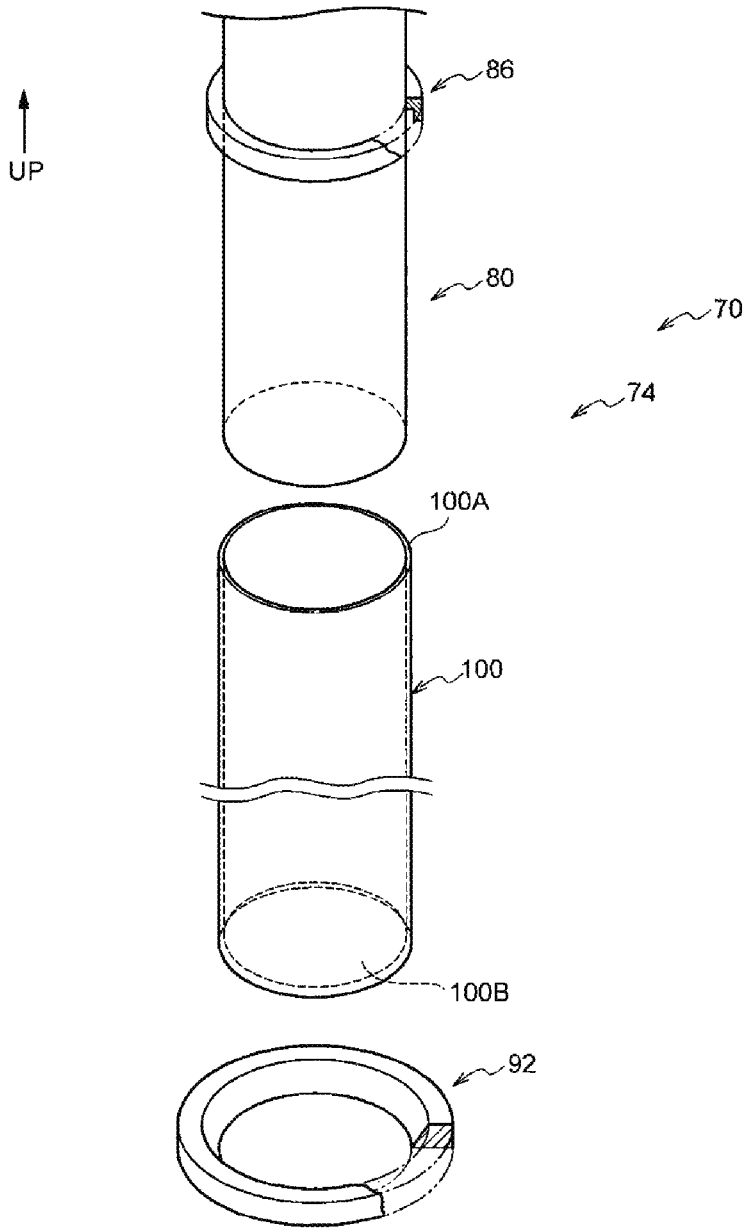
FIG. 3 is a schematic diagram illustrating an ironing apparatus is the exemplary embodiment.

As illustrated in FIG. 3, the ironing apparatus 74 is provided with a columnar mold 80 in which a portion on the tip end side is inserted into the cylindrical metal member 100 formed by impacting, and a preventing member 86 which prevents the movement of one end portion 100A of the cylindrical metal member 100. Further, the ironing apparatus 74 is provided with a pressing mold 92 in which the cylindrical metal member 100 is pressed to the outer circumferential surface of the columnar mold 80, and a mold releasing member 96 (refer to FIG. 9) which allows the cylindrical metal member 100 to be released from the columnar mold 80.

Columnar Mold

The columnar mold 80 is formed by using die steel (JIS-G4404: SKD11), and is a columnar extending in the vertical direction as illustrated in FIG. 3. In addition, the outer diameter (D1 in FIG. 5) of the columnar mold 80 is smaller than the inner diameter (D2 in FIG. 5) of the cylindrical metal member 100.

Figure 5:
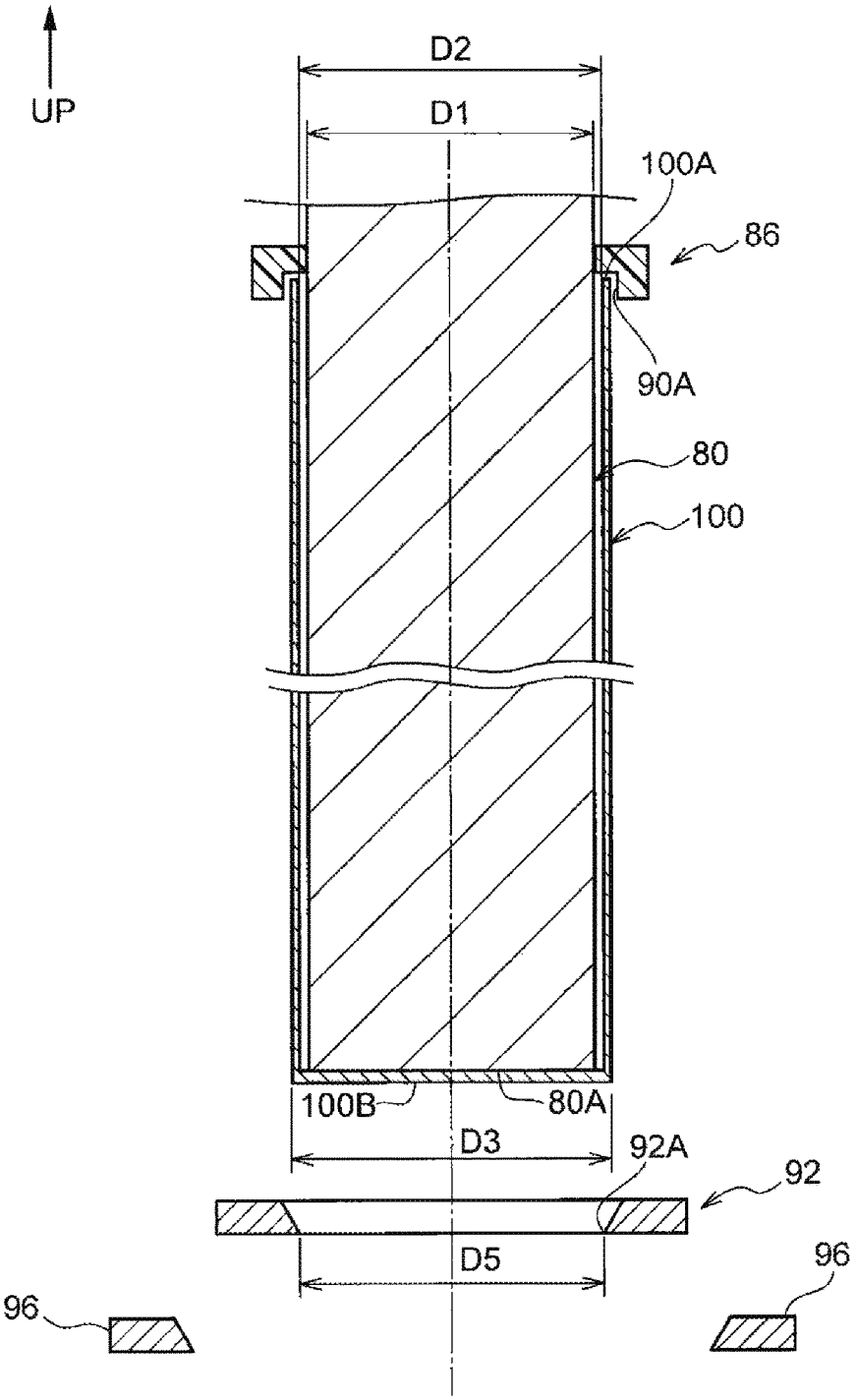
FIG. 5 is a sectional view of the mold structure in the exemplary embodiment.

For this reason, as illustrated in FIG. 5, in a state where a tip end portion 80A of the columnar mold 80 in which a portion on the tip end side (a portion on the lower side in FIG. 5) is inserted into the cylindrical metal member 100 contacts a bottom plate 100B of the cylindrical metal member 100 (hereinafter, referred to as "a state where the cylindrical metal member 100 is mounted to the columnar mold 80"), an interval is formed between the outer circumferential surface of the columnar mold 80 and the inner circumferential surface of the cylindrical metal member 100.

In this configuration, the columnar mold 80 to which a driving force is transferred from a driving source (not shown) is moved in the vertical direction.

Pressing Mold

The pressing mold 92 is formed by using, for example, cemented carbide (JIS B 4053-V10), and is formed into an annular as illustrated in FIG. 3. In addition, as illustrated in FIG. 5, the pressing mold 92 is disposed such that the center line of the pressing mold 92 overlaps the center line of the columnar mold 80. In addition, an annular protrusion 92A which is projected to the inner side of the pressing mold 92 in the radial direction is formed in the pressing mold 92.

The inner diameter (D5 in FIG. 5) of the protrusion 92A is larger than the outer diameter (D1 in FIG. 5) of the columnar mold 80, and is smaller than the outer diameter (D3 in FIG. 5) of the cylindrical metal member 100 after being formed by impact pressing.

With such a configuration, the columnar mold 80 in the state where the cylindrical metal member 100 is mounted to the columnar mold 80 is moved to the lower side, and the cylindrical metal member 100 passes through the inside of the pressing mold 92 such that the pressing mold 92 presses the cylindrical metal member 100 to the outer circumferential surface of the columnar mold 80.

Preventing Member

Figure 11:
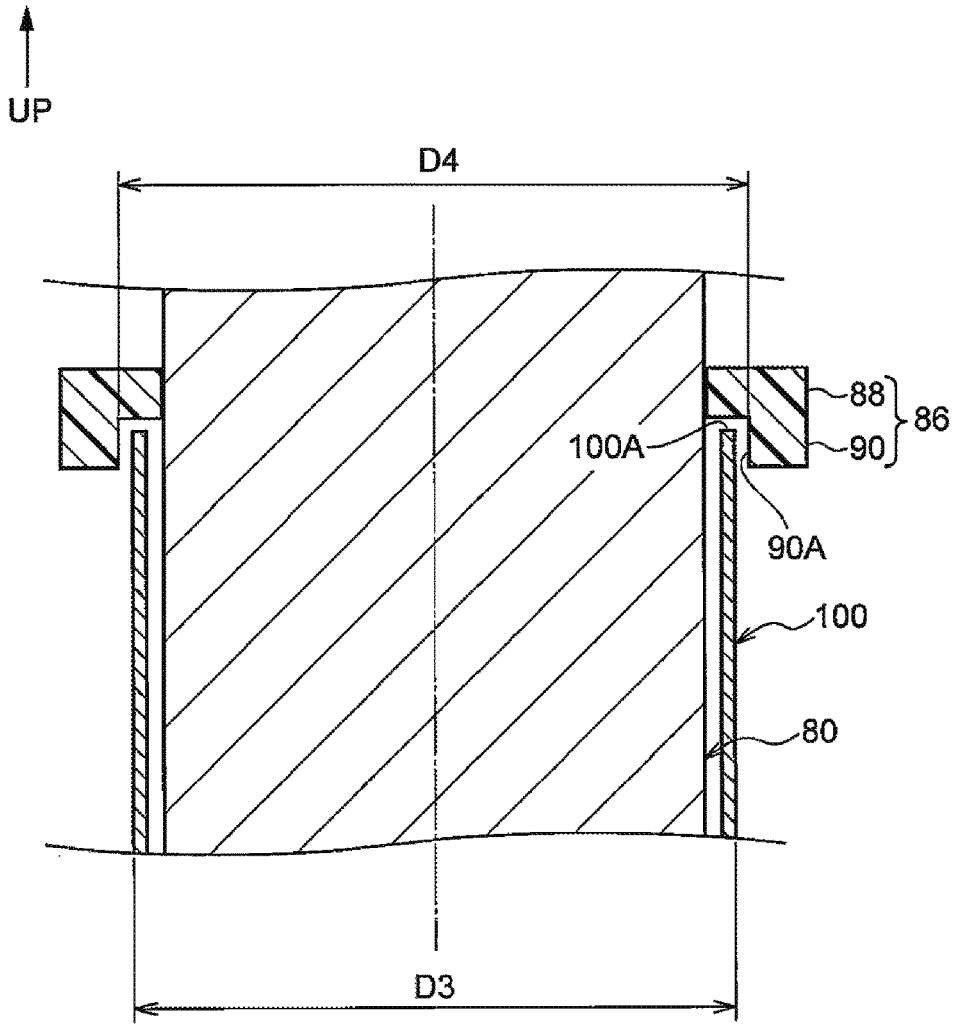
FIG. 11 is an enlarged sectional view of the mold structure in the exemplary embodiment.

The preventing member 86 is formed by using, for example, a nylon resin, and is formed into an annular shape as illustrated FIG. 3. In addition, the preventing member 86 includes a cylindrical portion 88 in which the inner circumferential surface contacts the outer circumferential surface of the columnar mold 80, and a projecting portion 90 downwardly projecting from the cylindrical portion 88, as illustrated in FIG. 11. Specifically, the projecting portion 90 downwardly projects from the portion of the outer side of the cylindrical portion 88 in the radial direction of the cylindrical portion 88. Further, a prevention surface 90A which faces the outer circumferential surface on the one end portion 100A side of the cylindrical metal member 100 is formed in the projecting portion 90 in the state where the cylindrical metal member 100 is mounted to the columnar mold 80. In addition, the prevention surface 90A is formed into a round shape when seen from the vertical direction (the axial direction of the columnar mold 80). An inner diameter (D4 in FIG. 11) of the prevention surface 90A of the preventing member 86 is larger than an outer diameter (D3 in FIG. 11) of the cylindrical metal member 100 after being formed by impact pressing.

With such a configuration, in the state where the cylindrical metal member 100 is mounted to the columnar mold 80, the preventing member 86 is configured to prevent the movement of the one end portion 100A of the cylindrical metal member 100 in the radial direction (the horizontal direction in FIG. 11) of the columnar mold 80. Further, when a force is applied to the preventing member 86 in the vertical direction (the axial direction of the columnar mold 80), the preventing member 86 slides the outer circumferential surface of the columnar mold 80.

Mold Releasing Member

Figure 9:
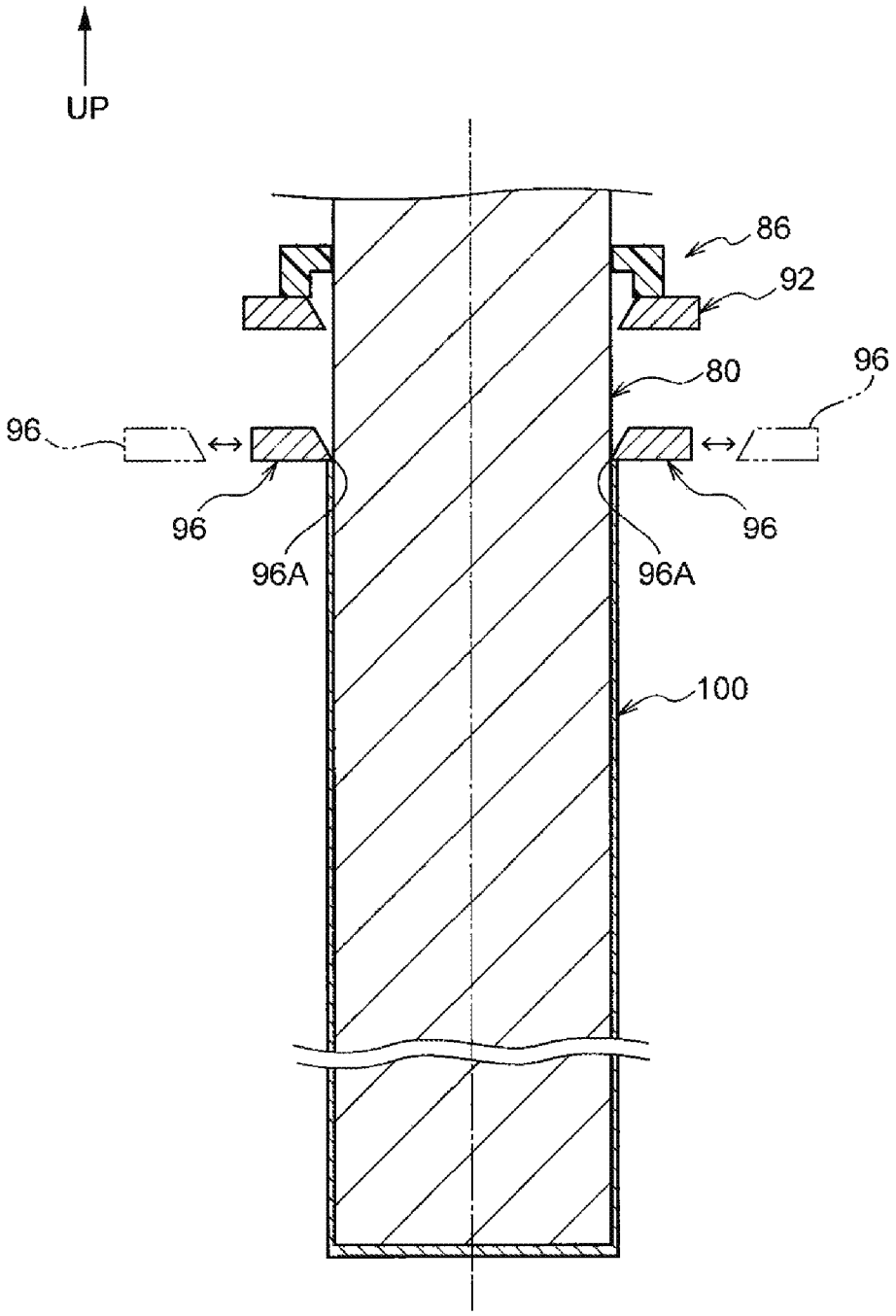
FIG. 9 is a sectional view of the mold structure in the exemplary embodiment.

As illustrated in FIG. 9, two of the mold releasing members 96 which are formed by using, for example, a metal material are provided on the lower side with respect to the pressing mold 92 so as to sandwich the columnar mold 80 of a portion which is moved to the lower side with respect to the pressing mold 92 from the radial direction of the columnar mold 80. In addition, a projection 96A which projects toward the outer circumferential surface of the columnar mold 80 is formed in each of the pressing molds 92.

With such a configuration, each of the mold releasing members 96 to which the driving force is transferred from the driving source (not shown) is moved to the direction (in the horizontal direction in FIG. 9) intersecting with the axial direction of the columnar mold 80. Also, each of the mold releasing members 96 is moved to between a contact position (a solid line in FIG. 9) where the projection 96A contacts the columnar mold 80 and a separated position (a dashed line in FIG. 9) where the projection 96A is separated from the columnar mold 80.

Meanwhile, operations of the respective portion of the ironing apparatus 74 will be described together with actions thereof.

Action of Major Configurations

Next, the action of the major configurations will be described through the steps of manufacturing the cylindrical metal member 100 by using the manufacturing apparatus 70 of the cylindrical metal member.

Impact Pressing Step

First, an impact pressing step of forming the cylindrical metal member 100 will be described by using the impact pressing apparatus 72 with reference to FIGS. 2A to 2C and FIGS. 4A and 4B.

In the impact pressing step, first, the lubricant is imparted at least onto the punch contact surface of the slag 102. The lubricant is preferably imparted onto the bottom surface (the surface being in contact with the concave mold 104) and the side surface other than the punch contact surface of the slag, in order to obtain the excellent surface properties of the outer circumferential surface of the cylindrical metal member.

The lubricant s not particularly limited; however, from the aspect of the prevention of the thickness variation, a powdered solid lubricant is preferable. The solid lubricant is preferably a fatty acid metal salt. Examples of the fatty acid metal salt include zinc stearate, calcium stearate, magnesium stearate, aluminum stearate and the like, and among them, zinc stearate is preferable.

The amount of the lubricant imparted is preferably from 0.15 $mg/cm^2$ to 0.5 $mg/cm^2$, and is further preferably from 0.2 $mg/cm^2$ to 0.4 $mg/cm^2$ from the aspect of the prevention of the thickness variation.

Then, the slag 102 in which lubricant is imparted onto at least the punch contact surface is disposed in the concave mold 104. Then, the slag disposed in the concave mold 104 is pressurized by using the columnar punch 106, the slag 102 is plastically deformed on the outer circumferential surface of the punch 106 so as to form the cylindrical metal member 100.

In the impact pressing step, first, as illustrated in FIG. 2A, the slag 102 is stored in the concave mold 104, and the punch 106 is disposed on the upper side of the concave mold 104.

Figure 2B:
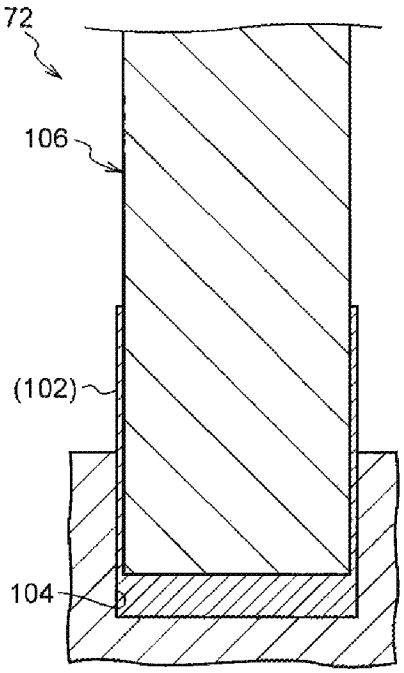
Figure 2C:
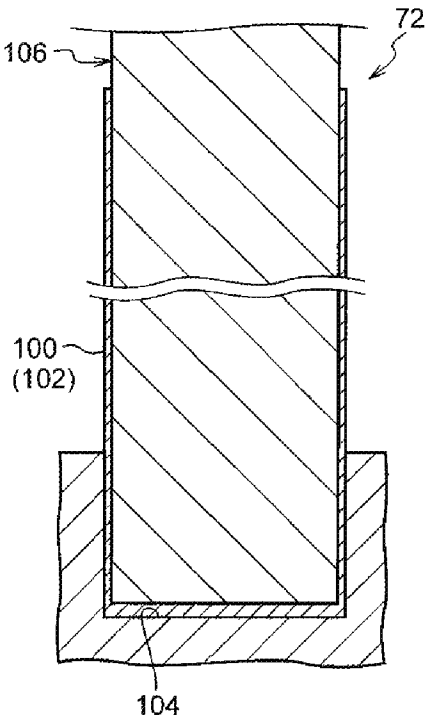

Next, as illustrated in FIGS. 2B and 2C, the punch 106 is moved to the lower side, and the punch 106 crushes and deforms the slag 102 stored in the concave mold 104. With this, the slag 102 is deformed to be cylindrical metal member 100 having a bottom along the circumferential surface of punch 106.

Figure 4B:
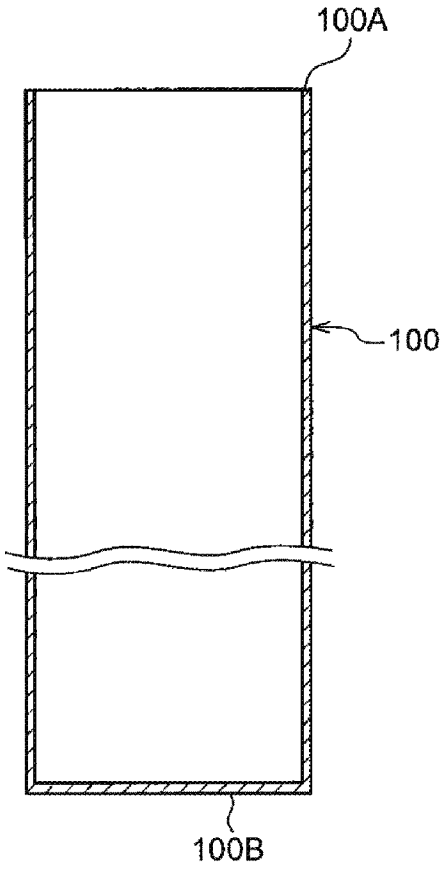
FIGS. 4A and 4B are sectional views of a mold structure in the exemplary embodiment.
Figure 4A:
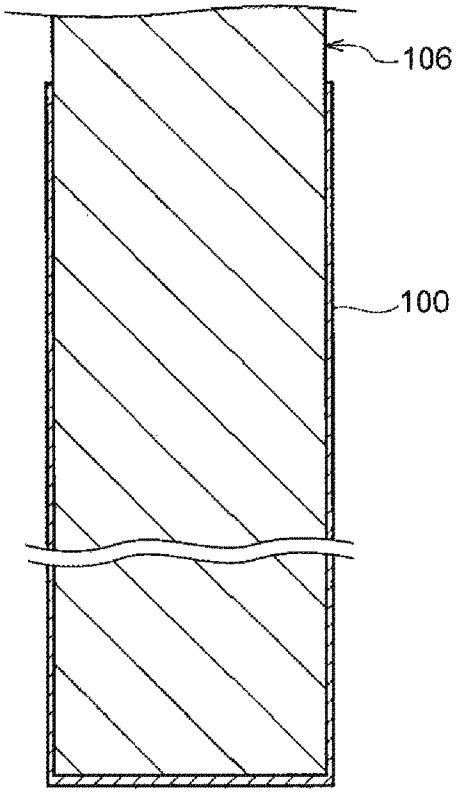

Next, the punch 106 is moved to the upper side such that the cylindrical metal member 100 which is closely attached to the punch 106 is separated from the concave mold 104 as illustrated in FIG. 4A.

Next, as illustrated in FIG. 4B, the cylindrical metal member 100 including the bottom plate 100B at another end portion to which one end portion 100A is opened is detached (separated) from the punch 106.

In this way, the cylindrical metal member 100 is formed by using the impact pressing apparatus 72.

Ironing Step

Next, the ironing step of correcting the shape of cylindrical metal member 100 by using the ironing apparatus 74 will be described with reference to FIG. 3, and FIG. 5 to FIG. 10.

The ironing step is a step of ironing the outer circumferential surface of the cylindrical metal member 100 by allowing the formed cylindrical metal member 100 to pass through the inside of the annular pressing mold 92 having an inner diameter which is smaller than the outer diameter of the cylindrical metal member 100.

In the ironing step, first, as illustrated in FIGS. 3 and 5, the columnar mold 80 is disposed on the upper side with respect to the pressing mold 92 in a state where the tip end portion 80A of the columnar mold 80 to which the portion on the tip end side of the columnar mold 80 is inserted contacts the bottom plate 100B of the cylindrical metal member 100. In addition, an this state, the prevention surface 90A of the preventing member 86 faces the outer circumferential surface on the one end portion 100A side of the cylindrical metal member 100. Further, the mold releasing member 96 is disposed in the separated position.

Figure 6:
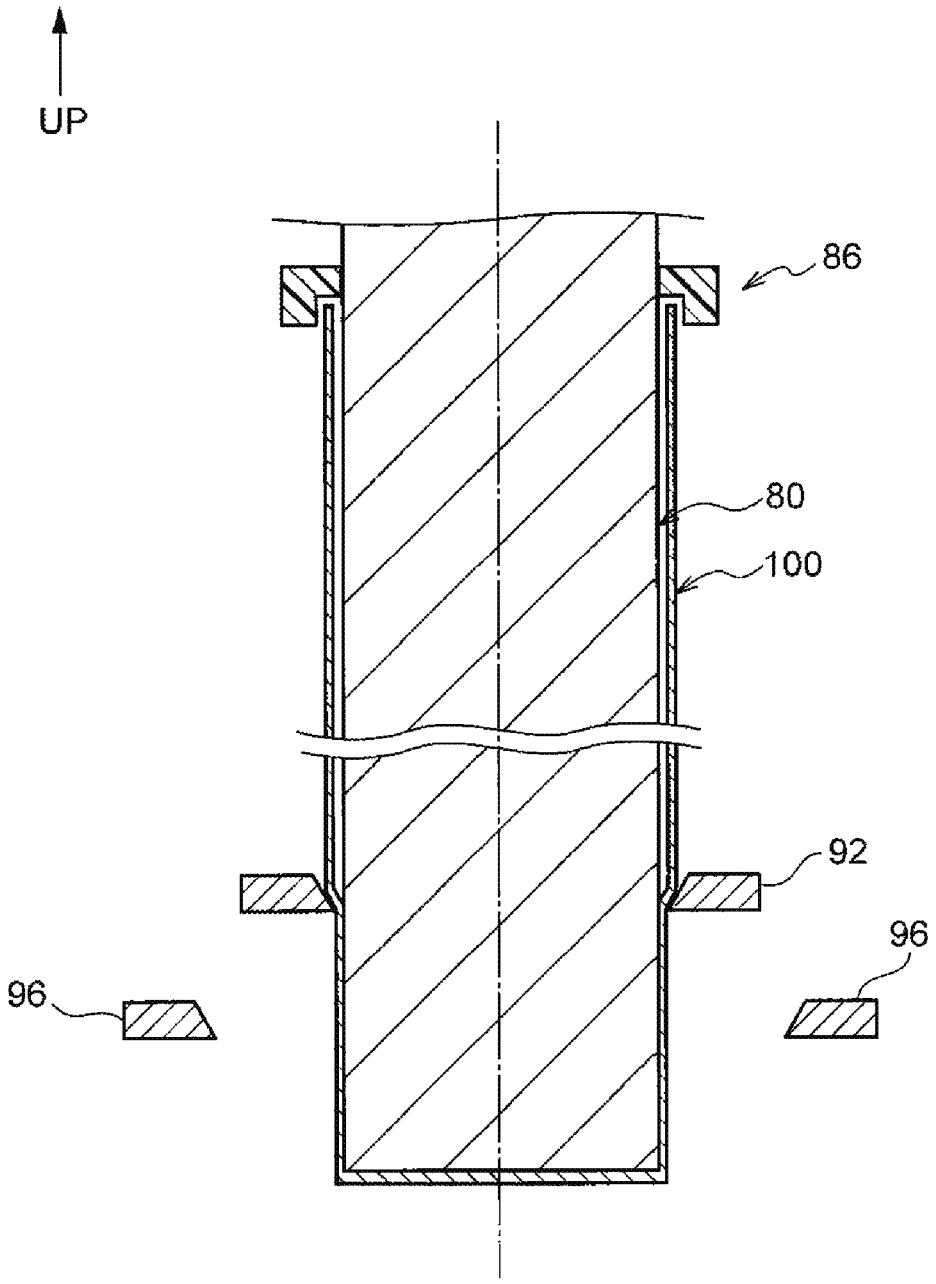
FIG. 6 is a sectional view of the mold structure in the exemplary embodiment.

Next, as illustrated in FIG. 6, the columnar mold 80 is moved to the lower side, and the cylindrical metal member 100 passes through the inside of the pressing mold 92 such that the pressing mold 92 presses the cylindrical metal member 100 to the outer circumferential surface of the columnar mold 80.

With this, the portion which passes through the inside of the pressing mold 92 in the cylindrical metal member 100 is plastically deformed so as to contact the outer circumferential surface of the columnar mold 80.

Figure 7:
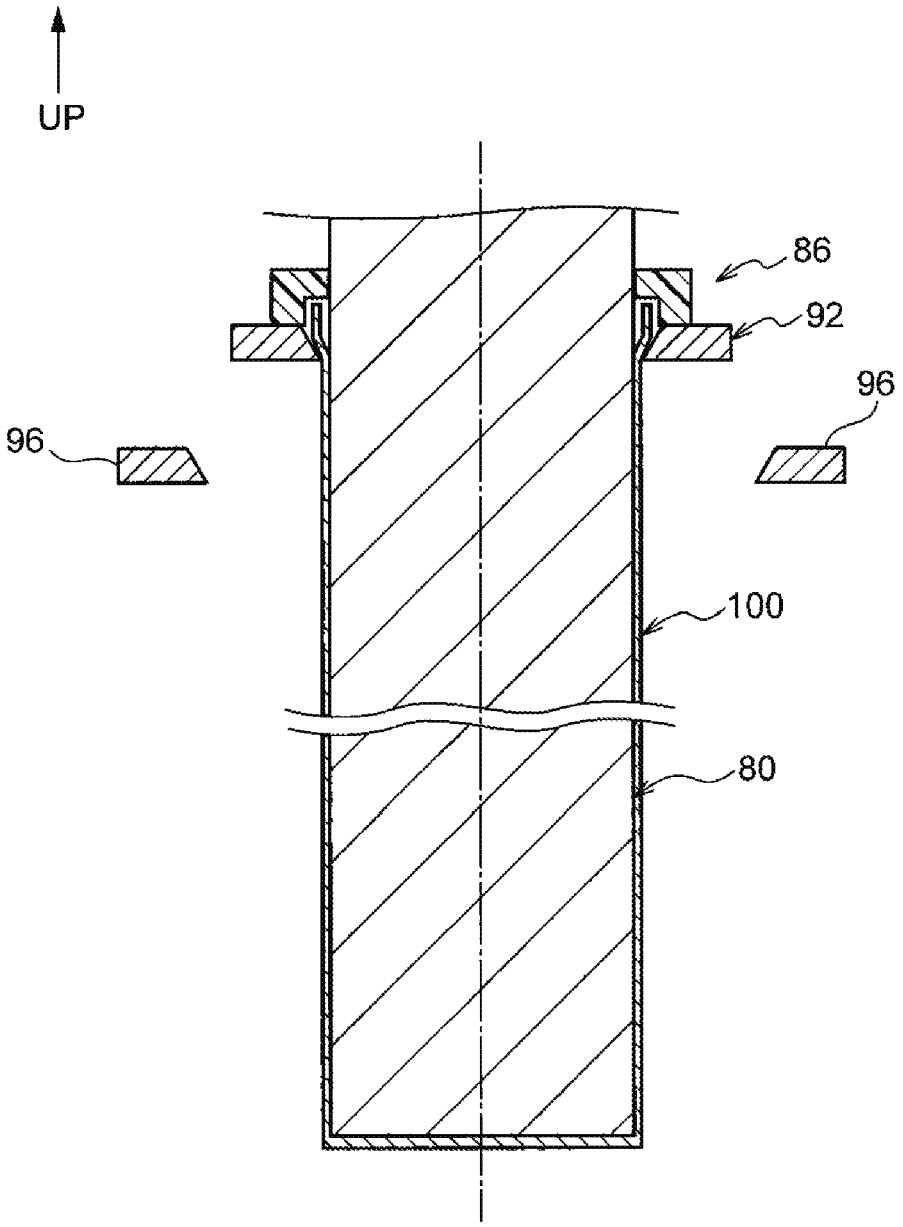
FIG. 7 is a sectional view of the mold structure in the exemplary embodiment.
Figure 8:
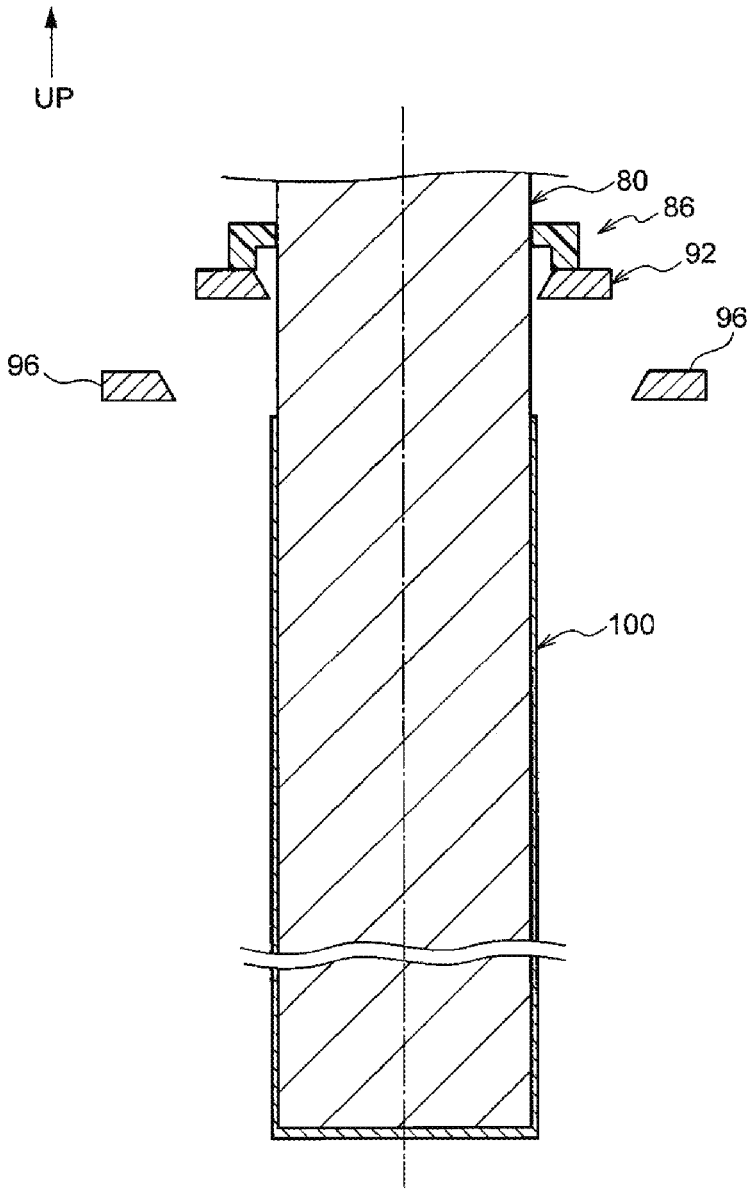
FIG. 8 is a sectional view of the mold structure in the exemplary embodiment.

Next, as illustrated in FIG. 7, the columnar mold 80 is further moved to the lower side such that the preventing member 86 contacts the pressing mold 92. Then, the columnar mold 80 is further moved to the lower side such that the preventing member 86 slides the outer circumferential surface of the columnar mold 80 as illustrated in FIG. 8. The cylindrical metal member 100 is moved to the lower side of the mold releasing member 96 in the vertical direction. When the cylindrical metal member 100 is moved to the lower side of the mold releasing member 96 in the vertical direction, the movement of the columnar mold 80 to the lower side is stopped.

Next, as illustrated in FIG. 9, the mold releasing member 96 moves to a contact position from the separated position.

Figure 10:
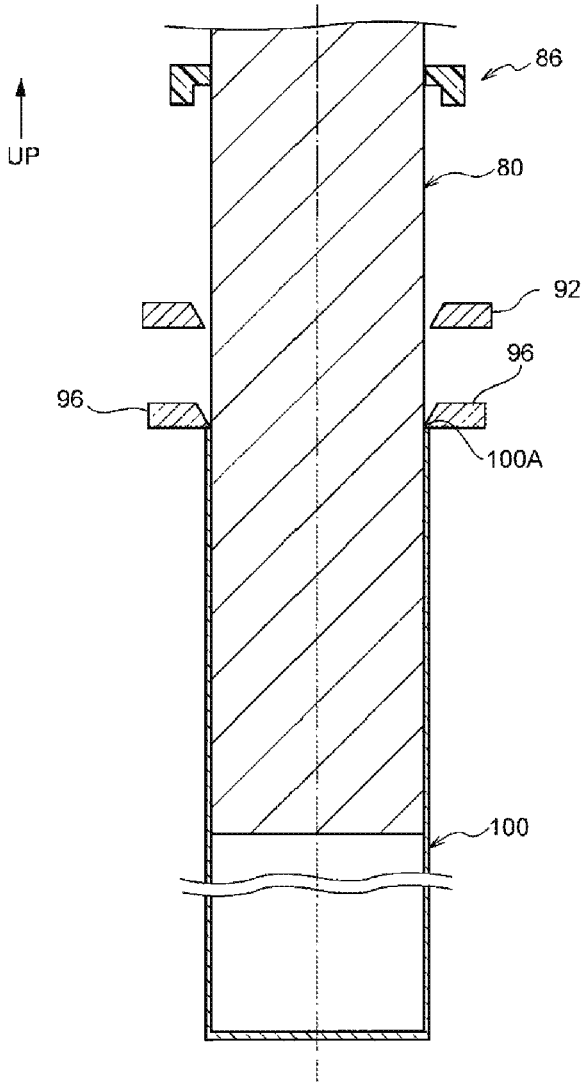
FIG. 10 is a sectional view of the mold structure in the exemplary embodiment.

Next, as illustrated in FIG. 10, the columnar mold 80 is moved to the upper side such that the mold releasing member 96 contacts the one end portion 100A of the cylindrical metal member 100, and the mold releasing member 96 regulates the movement of the cylindrical metal member 100 to the upper side With this, the cylindrical metal member 100 is separated from the columnar mold 80, and thereby the ironing step is completed.

Other Exemplary Embodiments

The method of preparing a cylindrical metal member according to the exemplary embodiment is not limited to the above-described embodiments.

For example, in the exemplary embodiment, the ironing is performed once, the ironing may be performed in plural times, and the diameter of the cylindrical metal member may be corrected in a stepwise manner.

In addition, before performing the ironing, an annealing may be performed so as to release a stress. The annealing may be performed as the post-treatment after performing the impact pressing.

In the exemplary embodiment, the cylindrical metal member 100 including the bottom plate 100B at another end portion to which one end portion 100A is opened is formed by impact pressing; however, the cylindrical metal member 100 may be formed by using other method.

In addition, in the exemplary embodiment, the columnar mold 80 is moved with respect to the pressing mold 92; however, the pressing mold 92 may be moved. That is, the columnar mold 80 and the pressing mold 92 may be relatively moved.

Further, in the exemplary embodiment, an interval is formed between the prevention surface 90A of the preventing member 86 and the outer circumferential surface of the cylindrical metal member 100; however, the prevention surface 90A of the preventing member 86 and the outer circumferential surface of the cylindrical metal member 100 may contact with each other (D4−D3=0)

Electroconductive Substrate for Electrophotographic Photoreceptor

The electroconductive substrate for an electrophotographic photoreceptor (hereinafter, also referred to as a "electroconductive substrate") according to the exemplary embodiment is formed of the cylindrical metal member according to the exemplary embodiment. In addition, the electroconductive substrate according to the exemplary embodiment is preferably obtained by the method of preparing a cylindrical metal member according to the exemplary embodiment.

In a case where the electrophotographic photoreceptor is used for a laser printer, the surface of the electroconductive substrate is preferably roughened with center line average roughness Ra from 0.04 μm to 0.5 μm so as to prevent interference fringes generated upon irradiation with a laser beam. Note that, in a case where the non-interference light is used as a light source, the roughening is not necessarily performed to prevent the interference fringes, defects caused by the ruggedness on the surface of the electroconductive substrate are prevented, and thereby the non-interference light is further suitable for long lifetime.

Examples of the roughening method include a wet honing process performed in such a manner that a polishing material is suspended in water and the suspension is sprayed to the electroconductive substrate, a centerless grinding process performed by continuously grinding by pressing a rotating grinding wheel with the electroconductive substrate, and an anodic oxidation treatment.

Examples of the roughening method also include a roughening method which is performed without roughening the surface of the electroconductive substrate by dispersing the conductive or semiconductive powders in the resin, forming a layer on the surface of the electroconductive substrate, and roughening the surface by the particles dispersed in the layer.

The roughening treatment by the anodic oxidation treatment, is performed in such a manner that a metallic (for example, aluminum) electroconductive substrate is set as an anode, and then is subjected to anodic oxidation in an electrolyte solution, thereby forming an oxide film on the surface of the electroconductive substrate. Examples of the electrolyte solution include a sulfuric acid solution, an oxalic acid solution, and the like. However, a porous anodic oxide film formed by the anionic oxidation in an initial state is in a chemically active state, and thus is likely to be contaminated, and resistance variation is large due to the environment. In this regard, it is preferable that the porous anodic oxide film is subjected to a pore-sealing treatment in which fine holes of the oxide film is treated by pressurized steam or boiling water (metal salts such as nickel may be added), and then volume expansion caused by a hydration reaction is prevented, and thus further stable hydrated oxide is obtained.

The thickness of the anodic oxide film is, for example, preferably from 0.3 μm to 15 μm. When the film thickness is in the above-described range, it is likely that barrier properties are exhibited with respect to injection, and an increase in residual potentials due to the repeated use is prevented.

The electroconductive substrate may be subjected to a treatment with an acidic treatment solution, or a boehmite treatment.

The treatment with the acidic treatment solution is performed as follows. First, an acidic treatment solution containing phosphoric acid, chromic acid, and hydrofluoric acid is prepared. As for the mixing ratio of the phosphoric acid, the chromic acid, and the hydrofluoric acid in the acidic treatment solution, the phosphoric acid is from 10% by weight to 11% by weight, the chromic acid is from 3% by weight to 5% by weight, and the hydrofluoric acid is from 0.5% by weight to 2% by weight, and. a concentration of the entire acids may be from 13.5% by weight to 18% by weight. The treatment temperature is preferably from 42° C. to 48° C. The thickness of the coating film is preferably from 0.3 μm to 15 μm.

The boehmite treatment is performed by impregnating the cylindrical substrate in pure water at 90° C. to 100° C. for 5 minutes to 60 minutes, or by keeping the cylindrical substrate in heated steam at 90° C. to 120° C. for 5 minutes to 60 minutes. The thickness of the coating film is preferably from 0.1 μm. to 5 μm. The treated cylindrical substrate may be further subjected to the anodic oxidation treatment by using an electrolyte solution having a low coating solubility such as adipic acid, boric acid, borate, phosphate, phthalate, maleate, benzoate, tartrate, and citrate.

Electrophotographic Photoreceptor

The electrophotographic photoreceptor according to the exemplary embodiment includes the electroconductive substrate according to the exemplary embodiment, and a photosensitive layer provided on the electroconductive substrate.

Figure 12:
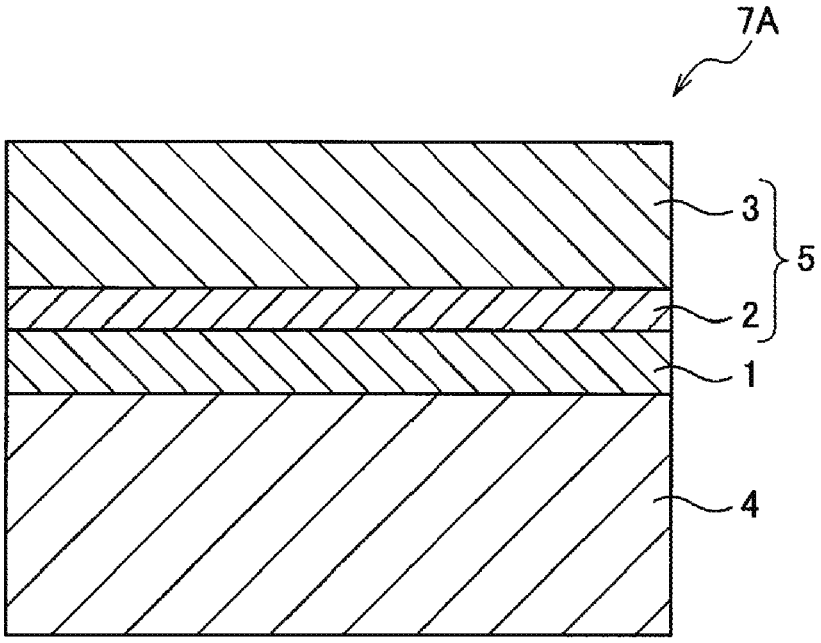
FIG. 12 is a schematic partial sectional view illustrating an example of a photoreceptor according to the exemplary embodiment.

Here, FIG. 12 is a schematic sectional view illustrating an example of a layer configuration of an electrophotographic photoreceptor 7A. The electrophotographic photoreceptor 7A as illustrated in FIG. 12 has a structure in which the undercoat layer 1, the charge generation layer 2, and the charge transport layer 3 are sequentially laminated on the electroconductive substrate 4, and. the charge generation layer 2 and the charge transport, layer 3 form the photosensitive layer 5.

FIG. 3 and FIG. 4 are schematic sectional views respectively illustrating another example of the layer configuration of the electrophotographic photoreceptor according to the exemplary embodiment.

Figure 13:
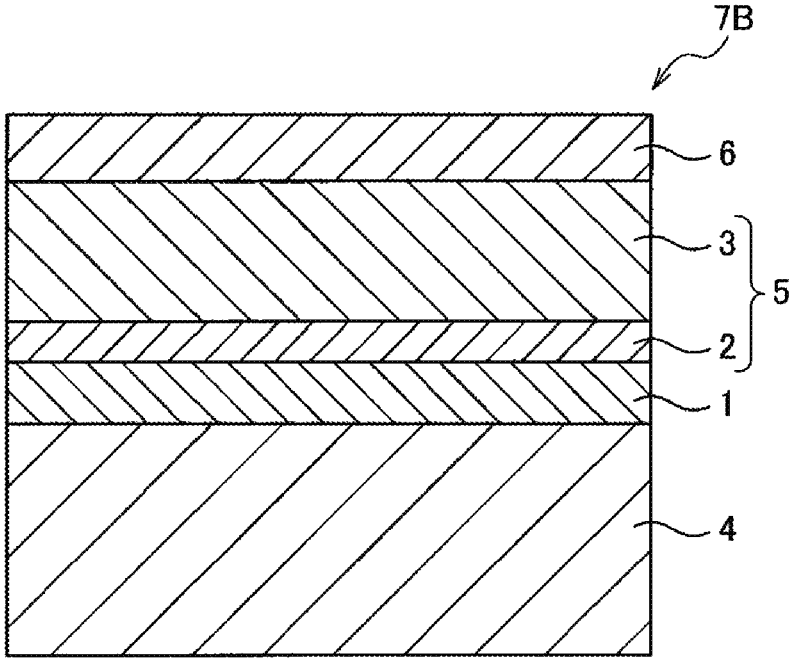
FIG. 13 is a schematic partial sectional view illustrating another configuration example of a photoreceptor according to the exemplary embodiment.
Figure 14:
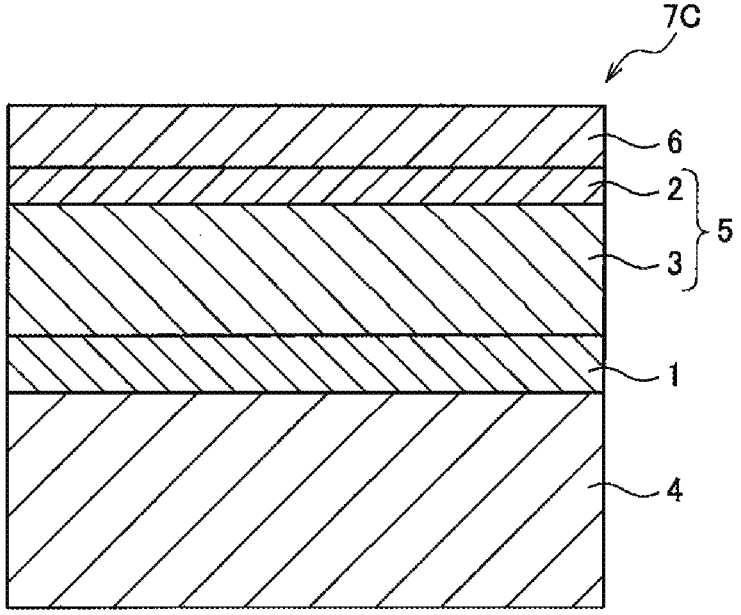
FIG. 14 is a schematic partial sectional view illustrating another configuration example of a photoreceptor according to the exemplary embodiment.

Similar to the electrophotographic photoreceptor 7A illustrated. in FIG. 12, the electrophotographic photoreceptors 7B and 7C illustrated in FIG. 13 and FIG. 14 include the photosensitive layer 5 of which the functions are divided into the charge generation layer 2 and the charge transport layer 3, and as a protective layer 6 is formed thereon as an outermost layer. The electrophotographic photoreceptor 7B illustrated in FIG. 13 has a structure in which the undercoat layer 1, the charge generation layer 2, the charge transport layer 3, and the protective layer 6 are sequentially laminated on the electroconductive substrate 4. The electrophotographic photoreceptor 7C illustrated in FIG. 14 has a structure in which the undercoat layer 1, the charge transport layer 3, the charge generation layer 2, and the protective layer 6 are sequentially laminated on the electroconductive substrate 4.

Note that, the undercoat layer 1 may not be necessarily provided in each of the electrophotographic photoreceptors 7A to 7C. In addition, each of the electrophotographic photoreceptors 7A to 7C is a single layer-type photosensitive layer in which functions of the charge generation layer 2 and the charge transport layer 3 are integrated may be employed.

Hereinafter, each of the layers of the electrophotographic photoreceptor will be described in detail. Note that, signs will be omitted.

Undercoat Layer

The undercoat layer a layer including, for example, an inorganic particle and a binder resin.

Examples of the inorganic particle include inorganic particles having powder resistance (volume resistivity) from $10^2$ Ωcm to $10^{11}$ Ωcm.

Among them, as the inorganic particle having the resistance value, metal oxide particles such as tin oxide particles, titanium oxide particles, zinc oxide particles, and zirconium oxide particles may be used, and particularly, the zinc oxide particles are preferably used.

A specific surface area by a BET method of the inorganic particle may be, for example, equal to or greater than 10 $m^2/g$.

The volume average particle diameter of the inorganic particle may be, for example, from 50 nm to 2,000 nm (preferably from 60 nm to 1,000 nm)

The content of the inorganic particle is, for example, is preferably from 10% by weight to 80% by weight, and is further preferably from 40% by weight to 80% by weight, with respect to the binder resin.

The inorganic particle may be subjected to the surface treatment. Two or more inorganic particles which are subjected to the surface treatment in a different way, or which have different particle diameters may be used in combination.

Examples of a surface treatment agent include a silane coupling agent, a titanate coupling agent, an aluminum-based coupling agent, and a surfactant. Particularly, the silane coupling agent is preferably used, and a silane coupling agent having an amino group is further preferably used.

Examples of the silane coupling agent having an amino group include 3-aminopropyl triethoxy silane, N-2-(aminoethyl)-3-aminopropyl trimethoxy silane, N-2-(aminoethyl)-3-aminopropyl methyl dimethoxy silane, and N,N-bis(2-hydroxy ethyl)-3-aminopropyl triethoxy silane; however, the silane coupling agent is not limited to these examples.

Two or more types of the silane coupling agents may be used in combination. For example, the silane coupling agent having an amino group and other silane coupling agents may be used in combination. Examples of other silane coupling agents include vinyltrimethoxysilane, 3-methacryloxypropyl-tris(2-methoxyethoxy) silane, 2-(3,4-epoxycyclohexyl) ethyl trimethoxy silane, 3-glycidoxypropyl trimethoxy silane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl dimethoxy silane, N,N-bis(2-hydroxyethyl)-3-aminopropyl triethoxy silane, 3-chloropropyl trimethoxy silane; however, other silane coupling agents are not limited to these examples.

The method of surface treatment by using the surface treatment agent is not limited as long as it is a well-known method, and a drying method or a wet method may be used.

The amount of the surface treatment agent is, for example, preferably from 0.5% by weight to 10% by weight with respect to the inorganic particle.

Here, the undercoat layer may include an inorganic particle and an electron-accepting compound (acceptor compound) from the viewpoint that long-term stability of electrical characteristics and the carrier blocking, properties are improved.

Examples of the electron-accepting compound include an electron transporting substance, for example, a quinone compound such as chloranil and Buromaniru; a tetracyanoquinodimethane compound; a fluorenone compound such as 2,4,7-trinitrofluorenone, 2,4,5,7-tetranitro-9-fluorenone; an oxadiazole compound such as 2-(4-biphenyl)-5-(4-t-butyl phenyl)-1,3,4-oxadiazole, 2,5-bis(4-naphthyl)-1,3,4-oxadiazole 2,5-bis(4-diethyl amino-phenyl) 1,3,4-oxadiazole; a xanthone compound; a thiophene compound; and a diphenoquinone compound such as 3,3', 5,5'tetra-t-butyl diphenoquinone.

Particularly, as the electron-accepting compound, a compound having an anthraquinone structure is preferably used. As the compound having an anthraquinone structure, for example, a hydroxyanthraquinone compound, an amino anthraquinone compound, and an amino hydroxy anthraquinone compound are preferably used, and specifically, anthraquinone, alizarin, quinizarin, anthrarufin, and purpurin are preferably used.

The electron-accepting compound. may be dispersed in the undercoat layer together with the inorganic particle, or may be attached on the surface of the inorganic particle.

Examples of the method of attaching the electron-accepting compound on the surface of the inorganic particle include a drying method and a wet method.

The drying method is a method of attaching the electron-accepting compound to the surface of the inorganic particle, for example, the electron-accepting compound or the electron-accepting compound which is dissolved in the organic solvent is added dropwise, and is sprayed with dry air or nitrogen gas while stirring the inorganic particle by using a large mixer having a shear force. The electron-accepting compound may be added dropwise or sprayed at a temperature below the boiling point of the solvent. After the electron-accepting compound is added dropwise or sprayed, sintering may be performed at a temperature of equal to or greater than 100° C. The sintering is not particularly limited as long as a temperature and time for obtaining the electrophotographic properties are provided.

The wet method is a method of attaching the electron-accepting compound to the surface of the inorganic particle by removing the solvent after the electron-accepting compound is added and stirred or dispersed while dispersing the inorganic particles in the solvent through a stirrer, ultrasound, a sand mill, an attritor, a ball mill, and the like As a method of removing a solvent, for example, the solvent is distilled off by filtration or distillation. After removing the solvent, sintering may be performed at a temperature of equal to or greater than 100° C. The sintering is not particularly limited as long as a temperature and time for obtaining the electrophotographic properties are provided. In the wet method, the water content of the inorganic particle may be removed before adding the electron-accepting compound, and examples thereof includes a method of removing the water content of the inorganic particle while stirring and heating in the solvent, and a method of removing the water content of the inorganic particle by forming an azeotrope with the solvent.

Note that, attaching the electron-accepting compound may be performed before or after performing the surface treatment on the inorganic particle by using a surface treatment agent, and the attaching of the electron-accepting compound and the surface treatment by using a surface treatment agent may be concurrently performed.

The content of the electron-accepting compound may be from 0.01% by weight to 20% by weight, and is preferably from 0.01% by weight to 10% by weight with respect to the inorganic particle.

Examples of the binder resin used for the undercoat layer include a well-known polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, vinyl chloride-vinyl acetate-maleic anhydride resin, a silicone resin, a silicone-alkyd resin, a urea resin, a phenol resin, a phenol-formaldehyde resin, a melamine resin, an urethane resin, an alkyd resin, and an epoxy resin; a zirconium chelate compound; a titanium chelate compound; an aluminum chelate compound; a titanium alkoxide compound; an organic titanium compound; and a well-known material such as an a silane coupling agent.

Examples of the binder resin used for the undercoat layer include a charge transport resin having a charge transport group, and a conductive resin (for example, polyaniline).

Among them, as the binder resin used for the undercoat layer, an insoluble resin in the coating solvent for the upper layer is preferably used. Particularly, examples thereof include a thermosetting resin such as a urea resin, a phenol resin, a phenol-formaldehyde resin, a melamine resin, a urethane resin, an unsaturated polyester resin, an alkyd resin, and an epoxy resin; and a resin obtained by reaction of at least one resin selected from the group consisting a polyamide resin, a polyester resin, a polyether resin, a methacrylic resin, an acrylic resin, a polyvinyl alcohol resin, and a polyvinyl acetal resin, and a curing agent.

In a case where two or more binder resins are used in combination, the mixing ratio thereof is set if necessary.

The undercoat layer may contain various types of additives so as to improve electrical properties, environmental stability, and image quality.

Examples of the additive include well-known materials, for example, an electron transporting pigment such as a polycyclic condensed pigment and an azo pigment, a zirconium chelate compound, a titanium chelate compound, an aluminum chelate compound, a titanium alkoxide compound, an organic titanium compound, and a silane coupling agent. The silane coupling agent is used for the surface treatment of the inorganic particle as described above, and may be also added to the undercoat layer as an additive.

Examples of the coupling agent as an additive include vinyl trimethoxy silane, 3-methacryloxy propyl-tris(2-methoxyethoxy)silane, 2-(3,4-epoxycyclohexyl)ethyl trimethoxy silane, 3-glycidoxypropyl trimethoxy silane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl dimethoxy silane, N,N-bis(2-hydroxyethyl)-3-aminopropyltri ethoxy silane, and 3-chloro-propyl trimethoxy silane.

Examples of the zirconium. chelate compound include zirconium butoxide, zirconium ethyl acetoacetate, zirconium triethanolamine, acetylacetonate zirconium butoxide, acetoacetic acid ethyl zirconium butoxide, zirconium acetate, zirconium oxalate, zirconium lactate, zirconium phosphonate, zirconium octane acid, naphthenic acid zirconium, zirconium lauric acid, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, poly titanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, and aluminum tris (ethyl acetoacetate).

The above-described additives may be used alone or may be used as a mixture of plural compounds or polycondensate.

The Vickers hardness of the undercoat layer may be equal to or greater than 35.

In order to prevent the occurrence of moire images, the surface roughness (ten-point average roughness) of the undercoat layer may be adjusted to 1/(4n) (n is the refractive index of the upper layer) to ½ of the using exposure laser wavelength λ.

The resin particle or the like may be added into the undercoat layer so as to adjust the surface roughness. Examples of the resin particle include a silicone resin particle, and a cross linked polymethyl methacrylate resin particle. In addition, the surface of the undercoat layer may be polished so as to adjust the surface roughness. Examples of a polishing method include a buffing method, a sandblasting method, a wet honing method, and a grinding method.

The forming of the undercoat layer is not particularly limited, and a well-known forming method is used. For example, the method is performed in such a manner that a coated film coated with the coating liquid for forming an undercoat layer which is formed by adding the above-described components to a solvent is coated, dried, and then heated if necessary.

Examples of the solvent for preparing the coating liquid for forming an undercoat layer include a well-known organic solvent such as an alcohol solvent, an aromatic hydrocarbon solvent, a halogenated hydrocarbon solvent, a ketone solvent, a ketone alcohol solvent, an ether solvent, and an ester solvent.

Specific examples of the solvent include general organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

A method of dispersing inorganic particles at the time of preparing the coating liquid for forming an undercoat layer includes a well-known method by using a roll mill, a ball mill, a vibrating ball mill, an attritor, a sand mill, a colloid mill, and a paint shaker.

Examples of the method of coating the electroconductive substrate with the coating liquid for forming an undercoat layer include a general method such as a blade coating method, a wire-bar coating method, a spray coating method, a dip-coating method, a bead coating method, an air knife coating method, and a curtain coating method.

The thickness of the undercoat layer is preferably set to be equal to or greater than 15 μm, and is further preferably set to be from 20 μm to 50 μm, for example.

Intermediate Layer

Although not shown in the drawings, an intermediate layer may be further provided between the undercoat layer and the photosensitive layer.

The intermediate layer is a layer including a resin. Examples of the resin used for the intermediate layer include a polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a chloride vinyl-vinyl acetate-maleic acid resin, a silicone resin, a silicone-alkyd resin, a phenol-formaldehyde resin, and a melamine resin.

The intermediate layer may be a layer including an organometallic compound. Examples of the organometallic compound used for the intermediate layer include an organometallic compound containing a metal atom such as zirconium, titanium, aluminum, manganese, and silicon.

The compounds used for the intermediate layer may be used alone, or may be used as a mixture of plural compounds or a polycondensate.

Among them, the intermediate layer is preferably a layer including an organometallic compound containing a zirconium atom or a silicon atom.

The forming of the intermediate layer is not particularly limited, and a well-known forming method is used. For example, the method is performed in such a manner that a coated film coated with the coating liquid for an intermediate layer which is formed by adding the above-described components to a solvent is coated, dried, and then heated if necessary.

Examples of a coating method for forming an intermediate layer include a dip-coating method, an extrusion coating method, a wire-bar coating method, a spray coating method, a blade coating method, a knife coating method, and a curtain coating method.

The thickness of intermediate layer is preferably set from 0.1 μm to 3 μm, for example. Note that, the intermediate layer may be used as an undercoat layer.

Charge Generation Layer

The charge generation layer includes, for example, a charge generation material and a binder resin. In addition, the charge generation layer may be a deposited layer of the charge generation material. The deposited layer of the charge generation material is preferably used in a case where a non-coherent light source such as a light emitting diode (LED), organic electro-luminescence (EL) image array.

Examples of the charge generation material include an azo pigment such as bisazo and trisazo; a condensed aromatic pigment such as dibromoanthanthrone; a perylene pigment; a pyrrolopyrrole pigment; phthalocyanine pigment; zinc oxide; and trigonal selenium.

Among them, in order to correspond to the laser exposure in the near infrared region, a metal phthalocyanine pigment, or a non-metal phthalocyanine pigment are preferably used as the charge generation material. Specific examples thereof include hydroxy phthalocyanine; chloro phthalocyanine; dichlorotin phthalocyanine; and titanyl phthalocyanine.

On the other hand, in order to correspond to the laser exposure in the near ultraviolet region, a condensed aromatic pigment such as dibromoanthanthrone; a thioindigo pigment; a porphyrazine compound; zinc oxide; trigonal selenium; and a bisazo pigment are preferably used as the charge generation material.

In a case of using the non-coherent light source such as LED, and the organic EL image array which have the central wavelength of the range of 450 nm to 780 nm, the above-described charge generation material may be used; however, in terms of the resolution, when the photosensitive layer having a thickness of equal to or less than 20 μm, the electric field strength is enhanced in the photosensitive layer, and charge reduction due to the charge injection from the substrate, and an image defect which is so-called "black dot" is likely to occur. This phenomine remarkable when the charge generation material which is a p-type semiconductor such as trigonal selenium and a phthalocyanine pigment, and easily causes a dark current is used.

In contrast, in a case of using an n-type semiconductor such as a condensed aromatic pigment, a perylene pigment, and an azo pigment as the charge generation material, the dark current is less likely to occur and the image defect which is the so-called dark dot may be prevented even with thin film.

Note that, the determination of the n-type is performed by polarity of flowing photocurrent with a time-of-flight method which is generally used, and a material which causes electrons to easily flow as carriers as compared with a hole is set as an n-type.

The binder resin used for the charge generation layer is selected from the insulating resins in a wide range, and the binder resin may be selected from organic photoconductive polymers such as poly-N-vinylcarbazole, polyvinyl anthracene, polyvinyl pyrene, and polysilanes.

Examples of the binder resin include a polyvinyl butyral resin, a polyarylate resin (a polycondensate of bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, an urethane resin, an epoxy resin, casein, a polyvinyl alcohol resin, and a polyvinyl pyrrolidone resin. Here "insulation properties" mean a case where the volume resistivity is equal to or greater than $10^{13}$ Ωcm.

These binder resins may be used alone or two or more types thereof may be used in combination.

Note that, the mixing ration of the charge generation material to the binder resin is preferably from 10:1 to 1:10 by the weight ratio.

The charge generation layer may include other well-known additives.

The charge generation layer is not particularly limited, and a well-known forming method is used. For example, the method is performed in such a manner that a coated film coated with the coating liquid for forming a charge generation layer which is formed by adding the above-described components to a solvent is coated, dried, and then heated if necessary. Note that, the forming of the charge generation layer may be performed by vaporizing the charge generation material. The forming of the charge generation layer performed by vaporizing the charge generation material is particularly preferable in a case where a condensed aromatic pigment, and a perylene pigment, are used as the charge generation material.

Examples of the solvent for preparing coating liquid for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or two or more type thereof are used in combination.

Examples of a method of dispersing the particles (for example, charge generation material) in the coating liquid forming a charge generation layer include a method by using a media dispersing machine such as a ball mill, a vibrating ball mill, an attritor, a sand mill, and a horizontal sand mill, and a media-less disperser such as a stirrer, an ultrasonic disperser, a roll mill, and a high pressure homogenizer. Examples of the high-pressure homogenizer include a collision-type homogenizer in which a dispersion is dispersed by liquid-liquid collision, and liquid-wall collision under high pressure, and a passing-through-type homogenizer in which a dispersion is dispersed by passing the dispersion through thin flow paths under high pressure.

Note that, at the time of this dispersion, the average particle diameter of the charge generation material in the coating liquid forming a charge generation layer is equal to or less than 0.5 μm, is preferably equal to or less than 0.3 μm, and further preferably equal to or less than 0.15 μm.

Examples of a method of coating the undercoat layer (or on the intermediate layer) with the coating liquid forming a charge generation layer include a general method such as a blade coating method, a wire-bar coating method, a spray coating method, a dip-coating method, a bead coating method, an air knife coating method, and a curtain coating method.

The thickness of the charge generation layer is preferably set to be from 0.1 μm to 5.0 μm, and is further preferably set to be from 0.2 μm to 2.0 μm, for example.

Charge Transport Layer

The charge transport layer is, for example, a layer including a charge transport material and a binder resin. The charge transport layer may be a layer including a polymer charge transport material.

Examples of the charge transport material include an electron transporting compound such as a quinone compound such as p-benzoquinone, chloranil, Buromaniru, and anthraquinone; a tetracyanoquinodimethane compound; a fluorenone compound such as 2,4,7-trinitrofluorenone; a xanthone compound; a benzophenone compound; and a cyanovinyl compound; an ethylene-based compound. Examples of the charge transport material include a hole-transporting compound such as a triarylamine compound, a benzidine compound, an arylalkane compound, an aryl substituted ethylene compound, a stilbene compound, an anthracene compound, and a hydrazine compound. These charge transport materials may be used alone or two or more types thereof may be used, but are not limited thereto.

As the charge transport material, in terms of charge mobility, a triarylamine derivative represented by the following formula (a-1) and a benzidine derivative represented by the following formula (a-2) are preferably used.

(a-1)

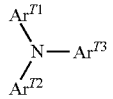

In the formula (a-1) , $Ar^{T1}$, $Ar^{T2}$ and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$ and $R^{T8}$ each independently represent a hydrogen atom, a substituted or unsubstituted alkyl group, or a substituted or unsubstituted aryl group.

Examples of the substituent of the respective groups include a halogen atom, an alkyl group having 1 to 5 carbon atoms, and an alkoxy group having 1 to 5 carbon atoms. In addition, examples of the substituent of the respective groups include a substituted amino group which is substituted with an alkyl group having 1 to 3 carbon atoms.

(a-2)

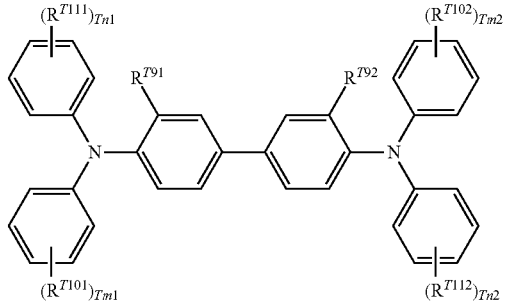

In the formula (a-2) , $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group which is substituted with an alkyl group having 1 to 2 carbon atoms, a substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1 and Tn2 each independently represent an integer of 0 to 2.

Examples of the substituent of the respective groups include a halogen atom, an alkyl group having 1 to 5 carbon atoms, and an alkoxy group having 1 to 5 carbon atoms. In addition, examples of the substituent, of the respective groups include a substituted amino group which is substituted with an alkyl group having 1 to 3 carbon atoms.

Here, among a triarylamine derivative represented by the formula (a-1) and a benzidine derivative represented by the formula (a-2), a triarylamine derivative having "$—C_6H_4—CH=CH—CH=C(R^{T7})(R^{T8})$", and a benzidine derivative having "$—CH=CH—CH=C(R^{T15})(R^{T16})$" are particularly preferable in terms of the charge mobility.

As the polymer charge transport material, a material having charge transporting properties such as poly-N-vinylcarbazole and polysilane is used. Particularly, a polyester polymer charge transport material, and the like is particularly preferable. Note that, the polymer charge transport material may be used alone, or may be used in combination with the binder resin.

Examples of the binder resin used for the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among them, as the binder resin, the polycarbonate resin and the polyarylate resin are preferably used. These binder resins may be used alone or two or more types thereof may be used in combination.

Note that, the mixing ratio of the charge transport material to the binder resin is preferably 10:1 to 1:5 by the weight ratio.

The charge transport layer may include other well-known additives.

The charge transport layer is not particularly limited, and a well-known forming method is used. For example, the method is performed in such a manner that a coated film coated with the coating liquid for forming a charge transport layer which is formed by adding the above-described components to a solvent is coated, dried, and then heated if necessary.

Examples of the solvent for preparing the coating liquid forming a charge transport layer includes general organic solvents such as aromatic hydrocarbons such as benzene, toluene, xylene, and chlorobenzene; ketones such as acetone and 2-butanone; halogenated aliphatic hydrocarbons such as methylene chloride, chloroform, and methylene chloride; and cyclic or linear ethers such as tetrahydrofuran and ethyl ether. These solvents may be used alone or two or more types thereof may be used in combination.

Examples of the method of coating the charge generation layer with the coating liquid for forming a charge transport layer include a general method such as a blade coating method, a wire-bar coating method, a spray coating method, a dip-coating method, a bead coating method, an air knife coating method, and a curtain coating method.

The thickness of the charge transport layer is, for example, preferably from 5 μm to 50 μm, and further preferably from 10 μm to 30 μm.

Protective Layer

The protective layer is provided on the photosensitive layer if necessary. For example, the protective layer is provided so as to prevent the photosensitive layer during charge from being chemically changed, or to further enhance the mechanical strength of the photosensitive layer.

For this reason, the protective layer may employ a layer formed of a cured film (a cross-linked membrane). Examples of these layers include layers described in the following description 1) or 2).

1) A layer which is formed of a cured film of a composition including a reactive group-containing charge transport material having a reactive group and a charge transport skeleton in the same molecule (that is, a layer including a polymer or a crosslinked polymer of the aforementioned reactive group-containing charge transport material)

2) A layer which is formed of a cured film of a composition including a non-reactive charge transport material and a reactive group-containing non-charge transport material having a reactive group without a charge transport skeleton (that is, a layer including a polymer or crosslinked polymer a non-reactive charge transport material and the aforementioned reactive group-containing non-charge transport material)

Examples of the reactive group of the reactive group-containing charge transport material include well-known reactive groups such as a chain polymerization group, an epoxy group, —OH, —OR (where R represents an alkyl group) , —$NH_2$, —SH, —COOH, and —$SiR^{Q1}_{3-Qn}(OR^{Q2})_{Qn}$ (where $R^{Q1}$ represents a hydrogen atom, an alkyl group, or a substituted or non-substituted aryl group, $R^{Q2}$ represents a hydrogen atom, an alkyl group, and a trialkylsilyl group, and Qn represents an integer of 1 to 3).

The chain polymerization group is not particularly limited as long as it is a functional group capable of radical polymerization, and examples thereof include a functional group having a group containing at least carbon double bond. Specific examples thereof include a group containing at least one selected from a vinyl group, a vinyl ether group, a vinyl thioether group, a styryl group (vinyl phenyl), an acryloyl group, a methacryloyl group, and derives thereof. Among them, in terms of excellent reactivity, a group containing at least one selected from a vinyl group, a styryl group (vinyl phenyl), an acryloyl group, a methacryloyl group, and the derives thereof is preferably used as the chain polymerization group.

The charge transport skeleton of the reactive group-containing charge transport material is not particularly limited as long as it is a well-known structure in the electrophotographic photoreceptor. For example, a skeleton derived from a nitrogen-containing hole transport compound such as a triarylamine compound, a benzidine compound, and a hydrazine compound is used, and examples thereof include a structure is conjugated a nitrogen atom. Among them, the triarylamine skeleton is preferably used.

The reactive group-containing charge transport material having the reactive group and the charge transport skeleton, the non-reactive charge transport material and the reactive group-containing charge transport material may be selected from well-known materials.

The protective layer may include other well-known additives.

The forming of the protective layer is not particularly limited, and a well-known forming method is used. For example, the method is performed in such a manner that a coated film coated with the coating liquid for forming a protective layer which is formed by adding the above-described components to a solvent is coated, dried, and then heated if necessary.

Examples of the solvent for preparing the coating liquid for forming a protective layer an aromatic solvent such as toluene and xylene; a ketone solvent such as methyl ethyl ketone, methyl isobutyl ketone, and cyclohexanone; an ester solvent such as ethyl acetate and butyl acetate; an ether solvent such as tetrahydrofuran and dioxane; a cellosolve solvent such as ethylene glycol monomethyl ether; and an alcohol solvent such as isopropyl alcohol and butanol. These solvents may be used alone or two or more types thereof may be used in combination.

Note that, the coating liquid for forming a protective layer may be a coating liquid of an inorganic solvent.

Examples of the method of coating the photosensitive layer (for example, a charge transport layer) with the coating liquid for forming a protective layer include a dip-coating method, an extrusion coating method, a wire-bar coating method, a spray coating method, a blade coating method, a knife coating method, and a curtain coating method.

The thickness of the protective layer is preferably from 1 μm to 20 μm, and further preferably from 2 μm to 10 μm.

Single Layer-Type Photosensitive Layer

The single layer-type photosensitive layer (a charge generation or a charge transport layer) is a layer including, for example, a charge generation material and a charge transport material, and a binder resin and other well-known additives if necessary. Note that, these materials are the same as those in the description of the charge generation layer and the charge transport layer.

In addition, in the single layer-type photosensitive layer, the content of the charge generation material may be from 10% by weight to 85% by weight, and is further preferably from 20% by weight to 50% by weight with respect to the entire solid content. In addition, in the single layer-type photosensitive layer, the content of the charge transport material may be from 5% by weight to 50% by weight with respect to the entire solid content.

The method of forming the single layer-type photosensitive layer is the same as the method of forming the charge generation layer or the charge transport layer.

The thickness of the single laver-type photosensitive layer is, for example, from 5 μm to 50 μm, and is further preferably from 10 μm to 40 μm.

Image Forming Apparatus (and Process Cartridge)

The image forming apparatus according to the exemplary embodiment includes the electrophotographic photoreceptor according to the exemplary embodiment, a charging unit that charges a surface of the electrophotographic photoreceptor, an electrostatic latent image forming unit that forms an electrostatic latent image on the charged surface of the electrophotographic photoreceptor, a developing unit that forms a toner image by developing the electrostatic latent image formed on the surface of the electrophotographic photoreceptor by using a developer containing a toner, and a transfer unit that transfers the toner image to a surface of a recording medium. In addition, as the electrophotographic photoreceptor, the electrophotographic photoreceptor according to the exemplary embodiment is employed.

As the image forming apparatus according to the exemplary embodiment, well-known image forming apparatuses such as an apparatus including fixing unit that fixes a toner image transferred on a surface of a recording medium; a direct-transfer type apparatus that directly transfers the toner image formed on the surface of the electrophotographic photoreceptor to the recording medium; an intermediate transfer type apparatus that primarily transfers the toner image formed on the surface of the electrophotographic photoreceptor to a surface of an intermediate transfer member, and secondarily transfers the toner image transferred to the intermediate transfer member to the surface of the recording medium; an apparatus including a cleaning unit that cleans the surface of the electrophotographic photoreceptor before being charged and after transferring the toner image; an apparatus includes an erasing unit that erases charges by irradiating the electrophotographic photoreceptor with erasing light before being charged and after transferring the toner image; and an apparatus including an electrophotographic photoreceptor heating member that increase the temperature of the electrophotographic photoreceptor so as to decrease a relative temperature are employed.

In a case where the intermediate transfer type apparatus is used, the transfer unit is configured to include an intermediate transfer member that transfers the toner image to the surface, a primary transfer unit that primarily transfers the toner image formed on the surface of the electrophotographic photoreceptor to the surface of the intermediate transfer member, and a secondary transfer unit that secondarily transfers the toner image transferred to the surface of the intermediate transfer member to the surface of the recording medium.

The image forming apparatus according to the exemplary embodiment may be any type of a dry developing type image forming apparatus and a wet developing type (developing type using a liquid developer) image forming apparatus.

Note that, in the image forming apparatus according to the exemplary embodiment, for example, a unit including the electrophotographic photoreceptor may be a cartridge structure (process cartridge) detachably attached to the image forming apparatus. As a process cartridge, for example, a process cartridge including the electrophotographic photoreceptor according to the exemplary embodiment is preferably used. In addition, in addition to the electrophotographic photoreceptor, at least one selected from the group consisting of a charging unit, an electrostatic latent image forming unit, a developing unit, and a transfer unit may be included in the process cartridge.

Hereinafter, an example of the image forming apparatus of the exemplary embodiment will be described; however, the invention is not limited thereto. Note that, in the drawing, major portions will be described, and others will not be described.

Figure 15:
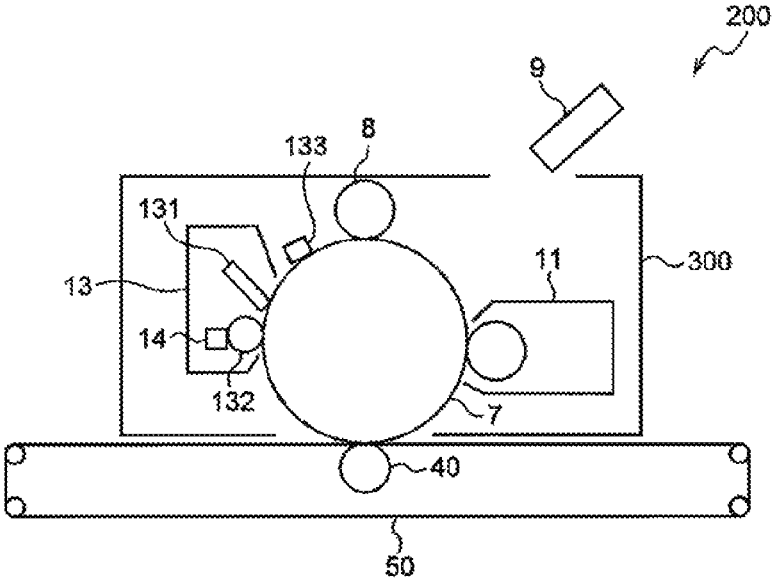
FIG. 15 is a schematic configuration diagram illustrating an example of an image forming apparatus according to the exemplary embodiment.

FIG. 15 is a schematic configuration diagram illustrating an example of the image forming apparatus according to the exemplary embodiment.

As illustrated in FIG. 15, an image forming apparatus 200 according to the exemplary embodiment includes a process cartridge 300 which is provided with an electrophotographic photoreceptor 7, an exposure device 9 (an example of the electrostatic latent image forming unit), a transfer device 40 (an example of the primary transfer device), and an intermediate transfer member 50. In addition, in the image forming apparatus 200, the exposure device 9 is disposed at a position so as to expose the electrophotographic photoreceptor 7 from an opening of the process cartridge 300, the transfer device 40 is disposed at a position facing the electrophotographic photoreceptor 7 via the intermediate transfer member 50, and the intermediate transfer member 50 is disposed such that a portion thereof contacts the electrophotographic photoreceptor 7. Although not shown, the image forming apparatus 200 also includes a secondary transfer device that transfers the toner image which is transferred to the intermediate transfer member 50 to a recording medium (for example, recording sheet). Note that, the intermediate transfer member 50, the transfer device 40 (the primary transfer device), and the secondary transfer device (not shown) correspond to examples of the transfer unit.

The process cartridge 300 in FIG. 15 integrally supports an electrophotographic photoreceptor 7, a charging device 8 (an example of the charging unit), a developing device 11 (an example of the developing unit), and a cleaning device 13 (an example of the cleaning unit) in a housing. The cleaning device 13 includes a cleaning blade (an example of the cleaning member) 131, the cleaning blade 131 is disposed so as to contact the surface of the electrophotographic photoreceptor 7. Note that, the cleaning member is not limited to the cleaning blade 131, and may be a conductive or an insulating fibrous member, which may be used alone or used in combination with the cleaning blade 131.

Meanwhile, FIG. 15 illustrates an example of the image forming apparatus including a fibrous member 132 (roller shape) for supplying a lubricant 14 to the surface of the electrophotographic photoreceptor 7, and a fibrous member 133 (flat brush) for assisting the cleaning step, and the above members are disposed in accordance with the use.

Hereinafter, the respective configurations of the image forming apparatus according to the exemplary embodiment will be described.

Charging Device

Examples of the charging device 8 include a contact type charging member using a conductive or a semi conductive charging roller, a charging brush, a charging film, a charging rubber blade, and a charging tube. In addition, well-known charging devices such as a non-contact type roller charger, a scorotron charger and a corotron charger each utilizing corona discharge are also used.

Exposure Device

Examples of the exposure device 9 include an optical device that exposes the light such as a semiconductor laser beam, LED light, and liquid crystal shutter light according to an image data on the surface of the electrophotographic photoreceptor 7. The wavelength of the light source is set to be within a spectral sensitivity region of the electrophotographic photoreceptor. The wavelength of the semiconductor laser beam is mainly near-infrared having an oscillation wavelength in the vicinity of 780 nm. However, the wavelength is not limited, the oscillation wavelength laser having a level of 600 nm or laser having the oscillation wavelength in a range of 400 nm to 450 nm as a blue laser may be also used. In addition, a surface emission-type laser light source capable of outputting a multi-beam is also effective to form a color image.

Developing Device

Examples of the developing device 11 include a general developing device that contacts or non-contacts a developer so as to develop an image. The developing device 11 is not particularly limited as long as it has the above-described function, and is selected on the purpose. For example, a well-known developing device having a function of attaching a single-component developer or a two-component developer to the electrophotographic photoreceptor 7 by using a brush, a roller, or the like may be exemplified. Among them, a developing roller holding the developer on the surface is preferably used.

The developer used for the developing device 11 may be a single-component developer containing only a toner or may be a two-component developer containing a toner and a carrier. In addition, the developer may be magnetic or non-magnetic. As the aforementioned developer, well-known developers are used.

Cleaning Device

As the cleaning device 13, a cleaning blade-type device including a cleaning blade 131 is used.

Note that, in addition to the cleaning blade-type device, a fur brush cleaning device and a simultaneous developing and cleaning device may be also employed.

Transfer Device

Examples of the transfer device 40 include well-known transfer charging device such as a contact, type transfer charging device using a belt, a roller, a film, a rubber blade, and the like, a scorotron transfer charging device using corona discharge, and a corotron transfer charging device are also used.

Intermediate Transfer Member

Examples of the intermediate transfer member 50 include a belt-type member (an intermediate transfer belt) containing polyimide, polyamideimide, polycarbonate, polyarylate, polyester, rubber, and the like to which semi conductivity is imparted. In addition, the shape of the intermediate transfer member may be a drum in addition to the belt shape.

Figure 16:
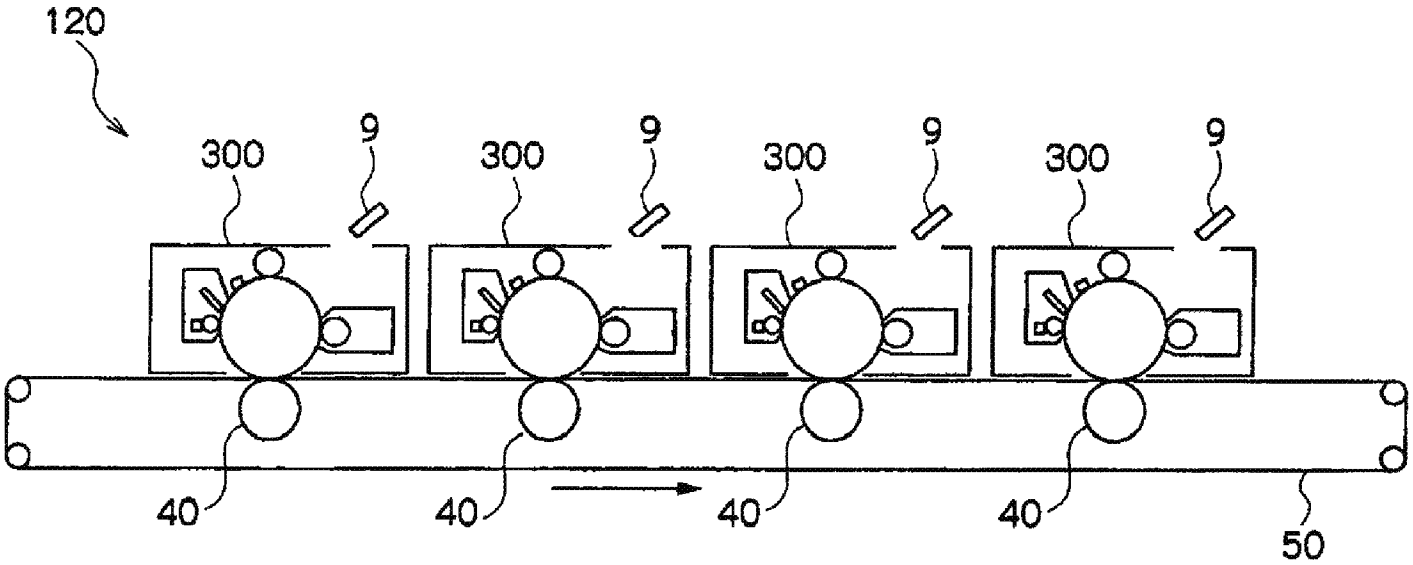
FIG. 16 is a schematic configuration diagram illustrating another example of an image forming apparatus according to the exemplary embodiment.

FIG. 16 is a schematic configuration diagram illustrating another example of an image forming apparatus according to the exemplary embodiment.

The image forming apparatus 120 illustrated in FIG. 16 is a tandem type multi-color image forming apparatus including four process cartridges 300. In the image forming apparatus 120, the four process cartridges 300 are arranged in parallel on the intermediate transfer member 50, and one electrophotographic photoreceptor is used for one color. Note that, the image forming apparatus 120 has a configuration which is the same as that of the image forming apparatus 200 except that it is a tandem type image forming apparatus.

EXAMPLES

Hereinafter, Examples of the present invention will be described; however, the invention is not limited to the following Examples. In the following description, unless specifically noted, "parts" and "%" are based on the weight.

Example 1

An aluminum plate having a thickness of 15 mm, which is formed of an alloy (JIS 1050) having an aluminum purity of 99.5% or more, is punched so as to prepare an aluminum columnar slag having a diameter of 34 mm and a thickness of 15 mm. Then, the punch contact surface of the slag is subjected to a blasting treatment under the following conditions.

Subsequently, the lubricant (powdered zinc stearate) is imparted to the entire surface of the slag in the amount of 0.3 $mg/cm^2$ and the resultant slag is formed into a cylindrical member having a diameter of 34 mm by the impact pressing.

Then, the ironing is performed once again, thereby preparing an aluminum conductive substrate (cylindrical metal member) having a diameter of 30 mm, a length of 251 mm, and a thickness of 0.8 mm.

Condition of Blasting Treatment

Polishing (media) material: zirconia

Size of polishing material: 50 μm

Irradiation pressure of polishing material: 0.3 MPa

Irradiation time of polishing material: 10 seconds

Examples 2 to 5, and Comparative Examples 1 to 4

The electroconductive substrates are prepared in the same manner as in the preparation of the electroconductive substrate in Example 1 except that the conditions for blasting treatment (the blasting pressure of the polishing material, the blasting time of the polishing material, and the size of the polishing material) with respect to the punch contact surface of the slag is changed as indicated in Table 1.

Slag and Properties of Electroconductive Substrate

With respect to the slag in each example, the roughness Rz in the maximum height and the average length RSm of the roughness curve element of the punch contact surface are measured according to the above-described method.

With respect to the electroconductive substrate in each example, the thickness variation, the roughness Rz in the maximum height of the inner circumferential surface, the average length RSm of the roughness curve element of the inner circumferential surface, and the outer circumferential surface hardness are measured according to the above-described method.

The results are shown in Table 1.

TABLE 1

| | Conditions of blasting treatment | | | Surface | | Properties of electroconductive substrate | | | |
|---|---|---|---|---|---|---|---|---|---|
| | Blasting pressure of polishing material (Mpa) | Blasting time of polishing material (second) | Size of polishing material (μm) | properties of punch contact surface of slag Rz (μm) | RSm (μm) | Thickness variation (μm) | Inner circumferential surfaces Rz (μm) | Inner circumferential surfaces RSm (μm) | Outer circumferential surface hardness (HV) |
| Example 1 | 0.3 | 10 | 50 | 20 | 250 | 35 | 6 | 290 | 46 |
| Example 2 | 0.5 | 60 | 50 | 50 | 250 | 34 | 19 | 80 | 54 |
| Example 3 | 0.4 | 10 | 20 | 35 | 150 | 36 | 14 | 70 | 49 |
| Example 4 | 0.4 | 20 | 180 | 35 | 400 | 38 | 17 | 280 | 50 |
| Example 5 | 0.5 | 30 | 50 | 35 | 250 | 15 | 13 | 180 | 51 |
| Comparative Example 1 | 0.3 | 5 | 50 | 18 | 250 | 41 | 3 | 350 | 45 |
| Comparative Example 2 | 0.5 | 80 | 50 | 52 | 250 | 43 | 22 | 40 | 59 |
| Comparative Example 3 | 0.4 | 15 | 10 | 35 | 140 | 42 | 14 | 40 | 50 |
| Comparative Example 4 | 0.4 | 15 | 220 | 35 | 410 | 41 | 24 | 320 | 51 |

As apparent from the results shown in Table 1, in the examples, the thickness variation is entirely prevented in the obtained electroconductive substrate (the cylindrical metal member) as compared with the comparative examples.

Examples 101 to 105 and Comparative Examples 101 to 104

A photoreceptor is prepared as follows by using the electroconductive substrate obtained in each of Examples 1 to 5 and Comparative Examples 1 to 4.

Preparation of Photoreceptor 100 parts by weight of zinc oxide (product name: MZ300, manufactured by Tayca Co., Ltd,), 10 parts by weight of toluene solution having 10% by weight of N-2-(amino-ethyl)-3-aminopropyl triethoxysilane as a silane coupling agent, and 200 parts by weight of toluene are mixed and stirred, and then the mixture is circulated for 2 hours. After that, the toluene is distilled under reduced pressure at 10 mmHg, and is sintered at 135° C. for 2 hours, thereby performing the surface treatment on zinc oxide with a silane coupling agent.

33 parts by weight of surface treated zinc oxide, 6 parts by weight of blocked isocyanate (product name: SUMIDUR 3175, manufactured by Sumitomo Bayer Urethane Co., Ltd), 1 part by weight of compound represented by the following formula (AK-1) , and 25 parts by weight of methyl ethyl ketone are mixed with each other for 30 minutes, and thereafter, 5 parts by weight of butyral resin (product name: S-LEC BM-1, manufactured by SEKISUI CHEMICAL CO., LTD), 3 parts by weight of silicone ball (product name: TOSPEARL 120, manufactured by Momentive Performance Materials Inc.), and 0.01 parts by weight of silicone oil as a leveling agent (product name: SH29PA, manufactured by Dow Corning Toray Silicone Co., Ltd) are added thereto, and then the mixture is dispersed for 3 hours with a sand mill, thereby obtaining a coating liquid for forming an undercoat layer.

Further, the electroconductive substrate is coated with the coating liquid for forming an undercoat layer according to a dip-coating method, and then dried and cured at 180° C. for 30 minutes, thereby obtaining an undercoat layer having a thickness of 30 μm.

(AK-1)

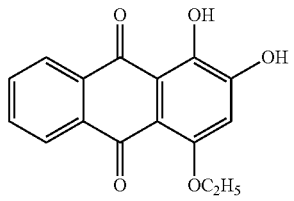

Next, a hydroxy phthalocyanine pigment "a V-type hydroxy phthalocyanine pigment having diffraction peaks at points where Bragg angles (2θ±0.2°) of an X-ray diffraction spectrum using the CuKα characteristic X-ray are at least 7.3°, 16.0°, 24.9°, and 28.0° (the maximum peak wavelength in the spectral absorption spectrum within wavelength range of 600 nm to 900 nm is 820 nm, the average particle diameter is 0.12 μm, the maximum particle size is 0.2 μm, and the specific surface area value is 60 $m^2/g$)" as the charge generation material, a vinyl chloride-vinyl acetate copolymer resin (product name: VMCH, Manufactured by Nippon Unicar Co., Ltd.) as the binder resin, and the mixture formed of n-butyl acetate are put into a glass bottle having a capacity of 100 mL together with glass beads of 1.0 mmφ at a 50% filling rate, and a dispersion treatment is performed for 2.5 hours by using a paint shaker, thereby obtaining a coating liquid for forming a charge generation layer. The content of the hydroxy phthalocyanine pigment is set to be 55.0% by volume, and the solid content of the dispersion is set to be 6.0% by weight, with respect, to the mixture of the hydroxy phthalocyanine pigment and the vinyl chloride-vinyl acetate copolymer resin. The content is calculated by setting the specific gravity of the hydroxy phthalocyanine pigment to be 1.606 $g/cm^3$, and the specific gravity of the vinyl chloride-vinyl acetate copolymer resin to be 1.35 $g/cm^3$.

The obtained coating liquid forming a charge generation layer is coated on the undercoat layer according to a dip-coating method, and dried at 130° C. for 5 minutes, thereby forming a charge generation layer having a thickness of 0.20 μm.

Next, 8 parts by weight of butadiene charge transport material (CT1A) and 32 parts by weight of benzidine charge transport material (CT2A) as the charge transport material, and 58 parts by weight of bisphenol Z-type polycarbonate resin (homopolymer type polycarbonate resin of bisphenol Z, and the viscosity-average molecular weight: 40,000) as the binder resin, 2 parts by weight (5% by weight with respect to total 100% by weight of the charge transport material) of hindered phenol antioxidant (HP-1, molecular weight 775) as the antioxidant are added and dissolved into 340 parts by weight of tetrahydrofuran, and thereby the coating liquid for forming a charge transport layer is obtained.

The obtained coating liquid forming a charge transport layer is coated on the charge generation layer according to a dip-coating method, and dried at 145° C. for 30 minutes, thereby forming a charge transport layer having a thickness of 30 μm.

The photoreceptors are obtained through the above-described steps. In addition, the obtained photoreceptors are evaluated as follows.

Evaluation

After press fitting of the flange, a fitting strength test between the photoreceptor and the flange was carried out with a torque testing machine. Evaluation criteria are as follows.

A: Equal to or greater than 3.0 Nm

B: Equal to or greater than 2.0 Nm and less than 3.0 Nm

C: Equal to or greater than 1.8 Nm and less than 2.0 Nm

D: Less than 1.8 Nm

TABLE 2

| | Electroconductive substrate to be used | Evaluation |
|---|---|---|
| Example 101 | Example 1 | B |
| Example 102 | Example 2 | A |
| Example 103 | Example 3 | A |
| Example 104 | Example 4 | A |
| Example 105 | Example 5 | B |
| Comparative Example 101 | Comparative Example 1 | D |
| Comparative Example 102 | Comparative Example 2 | C |
| Comparative Example 103 | Comparative Example 3 | C |
| Comparative Example 104 | Comparative Example 4 | C |

From the above results, it is understood that in the examples, the torque proof stress is higher than that in Comparative Examples Details of the charge transport material and the antioxidant which are used to form a charge transport layer are as follows.

Butadiene charge transport material: compound represented by the following formula (CT1A)

Benzidine charge transport material: compound represented by the following formula (CT2A)

Hindered phenol antioxidant: compound represented by the following formula (HP-1)

(CT1A)

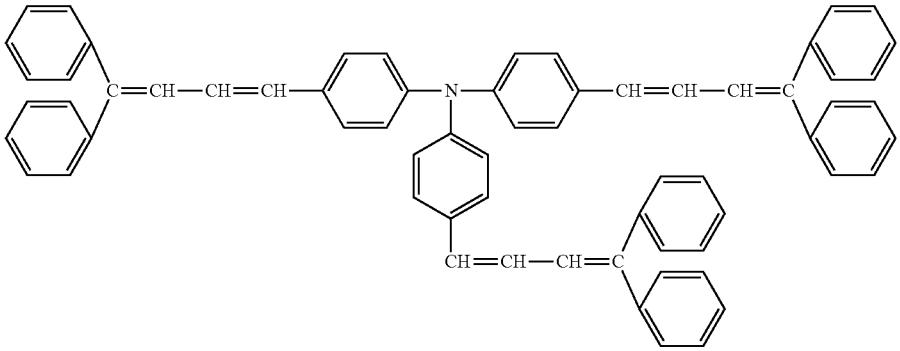

(CT2A)

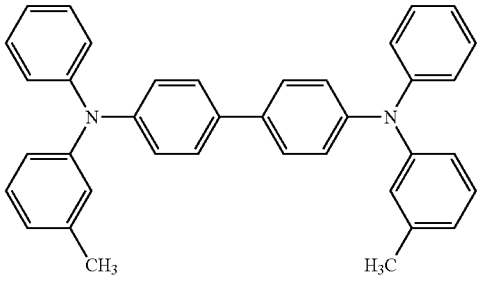

-continued (HP-1)

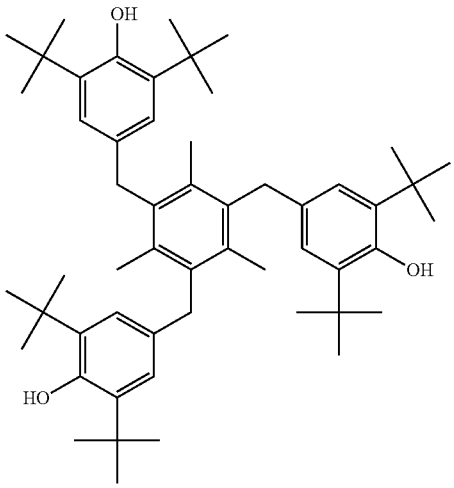

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cylindrical metal member having:

a thickness deviation of 40 μm or less, a maximum height roughness Rz of an inner circumferential surface of from 0.5 μm to 20 μm, an average length of a roughness curve element RSm of the inner circumferential surface of from 50 μm to 300 μm, and an outer circumferential surface hardness of from 45 HV to 60 HV.

2. The cylindrical metal member according to claim 1, wherein the maximum height roughness Rz of the inner circumferential surface is from 5 μm to 20 μm.

3. The cylindrical metal member according to claim 1, wherein the maximum height roughness Rz of the inner circumferential surface is from 8 μm to 17 μm.

4. The cylindrical metal member according to claim 1, wherein the average length of the roughness curve element RSm of the inner circumferential surface is from 100 μm to 250 μm.

5. The cylindrical metal member according to claim 1, wherein the average length of the roughness curve element RSm of the inner circumferential surface is from 120 μm to 200 μm.

6. The cylindrical metal member according to claim 1, which is an impact press tube.

7. An electrophotographic photoreceptor comprising:

an electroconductive substrate formed of the cylindrical metal member according to claim 1; and a photosensitive layer provided on the electroconductive substrate.

* * * * *